US011749054B2

(12) United States Patent
Uss et al.

(10) Patent No.: US 11,749,054 B2
(45) Date of Patent: Sep. 5, 2023

(54) SYMBOL FRAME WITH PRIZE

(71) Applicant: Aristocrat Technologies, Inc., Las Vegas, NV (US)

(72) Inventors: Jeffrey Uss, Liberty Hill, TX (US); Hanna Sanborn, Georgetown, TX (US); Jennifer Mizzi, Round Rock, TX (US); Rogelio Decasa, Jr., Renton, WA (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 199 days.

(21) Appl. No.: 16/805,575

(22) Filed: Feb. 28, 2020

(65) Prior Publication Data

US 2021/0183199 A1 Jun. 17, 2021

Related U.S. Application Data

(60) Provisional application No. 62/948,085, filed on Dec. 13, 2019.

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 9,214,072 | B2 | 12/2015 | Saunders | |
| 9,600,958 | B2 | 3/2017 | Lange et al. | |
| 9,640,025 | B2 | 5/2017 | Saunders | |
| 10,176,671 | B1 | 1/2019 | Halvorson | |
| 10,332,336 | B1 | 6/2019 | Halvorson | |
| 2004/0082384 | A1* | 4/2004 | Walker | G07F 17/3239 463/40 |

(Continued)

OTHER PUBLICATIONS

International Search Report and Written Opinion for App. No. PCT/US20/27551, dated Jun. 26, 2020, 8 pages.

(Continued)

*Primary Examiner* — Robert T Clarke, Jr.
*Assistant Examiner* — Jeffrey K Wong
(74) *Attorney, Agent, or Firm* — Weaver Austin Villeneuve & Sampson LLP

(57) ABSTRACT

Some implementations may involve providing a slot game in which the game outcome presentation may involve displaying a prize-on frame in one or more display symbol locations. In some examples, the display symbol locations in which a prize-on frame may be displayed are predetermined display symbol locations, such as locations of one or more particular slot reels. Each of the prize-on frames may be displayed around a display symbol that is selected to be displayed in the display symbol location corresponding to a prize-on frame. If a display symbol corresponding to a prize-on frame is part of a winning combination, a prize indicated on the prize-on frame may be awarded. The prize may, for example, be a particular credit value that is indicated on the prize-on frame, the current value of a particular jackpot that is indicated on the prize-on frame, etc.

19 Claims, 19 Drawing Sheets

(56) References Cited

U.S. PATENT DOCUMENTS

| | | | | |
|---|---|---|---|---|
| 2006/0148562 | A1* | 7/2006 | Walker | G07F 17/32 463/30 |
| 2007/0087805 | A1 | 4/2007 | Taylor | |
| 2008/0287179 | A1 | 11/2008 | Berman et al. | |
| 2009/0143135 | A1 | 6/2009 | Yoshizawa | |
| 2009/0156287 | A1 | 6/2009 | Baumgartner | |
| 2012/0270631 | A1* | 10/2012 | Graves | G07F 17/3244 463/19 |
| 2014/0194184 | A1 | 7/2014 | Lange et al. | |
| 2016/0232740 | A1 | 8/2016 | Janosov | |
| 2017/0032626 | A1 | 2/2017 | Shai-Hee | |
| 2017/0236381 | A1 | 8/2017 | Zielinski | |
| 2018/0130303 | A1* | 5/2018 | Lamb | G07F 17/3288 |
| 2019/0080561 | A1 | 3/2019 | Berman et al. | |
| 2021/0104123 | A1* | 4/2021 | Shepherd | G07F 17/3255 |

OTHER PUBLICATIONS

"Diamond Eyes," slot game, Ainsworth Game Technology. Mar. 11, 2020 screenshot from YouTube video. Publication date Jun. 21, 2016, 1 page.

"Ocean Magic™ Video Slots by IGT," Mar. 11, 2020 screenshot from YouTube video. Publication date Apr. 3, 2017, 1 page.

* cited by examiner

600

SYMBOL FRAME WITH PRIZE

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

One innovative aspect of the subject matter described in this disclosure may be implemented in an apparatus. The apparatus may include an interface system, a display system and a control system. In some examples, the apparatus may be a gaming device. The interface system may include at least one network interface and at least one user interface.

The control system may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. According to some examples, the control system may be configured for receiving, via the interface system, user input for initiation of an instance of a wagering game. The wagering game may be a slot game. The control system may be configured for determining a game outcome and corresponding display symbols for the instance of the wagering game.

In some examples, determining the game outcome may involve determining whether a game outcome presentation will involve displaying a prize-on frame in one or more predetermined display symbol locations and determining a game outcome award. The control system may be configured for controlling the display system to display the game outcome. Displaying the game outcome may involve displaying the display symbols at a plurality of display symbol locations on a display device of the display system. The plurality of display symbol locations may, for example, be arranged in a plurality of display symbol rows and display symbol columns. For game instances in which it is determined that the game outcome presentation will involve displaying a prize-on frame in one or more predetermined display symbol locations, displaying the game outcome may involve displaying the prize-on frame around one or more of the display symbols in the one or more predetermined display symbol locations. The control system may be configured for controlling the display system to present award effects corresponding to a game outcome award determination.

According to some implementations, the game outcome presentation may involve displaying a prize-on frame in a predetermined display symbol location. Determining the game outcome award may involve determining whether a display symbol presented in the predetermined display symbol location is part of a winning combination of display symbols. If it is determined that the display symbol presented in the predetermined display symbol location is part of the winning combination of display symbols and if the prize-on frame indicates a credit value, determining the game outcome award may involve awarding a credit value corresponding to the credit value indicated on the prize-on frame. If it is determined that the display symbol presented in the predetermined display symbol location is part of the winning combination of display symbols and if the prize-on frame indicates a progressive jackpot, determining the game outcome award may involve awarding a credit value corresponding to a current credit value of the progressive jackpot.

In some instances, if the control system determined that no prize-on frame would be presented for an instance of the wagering game immediately prior to a current instance of the wagering game and the control system determines that a prize-on frame will be displayed during the current instance of the wagering game, the control system may be configured to determine that the prize-on frame can only be displayed in a predetermined initial display symbol location. The predetermined initial display symbol location may, for example, be a predetermined display symbol column. The predetermined initial display symbol location may, for example, be a predetermined display symbol row of the predetermined display symbol column.

If the control system determines that a prize-on frame will be presented in the predetermined initial display symbol location, in some implementations the control system may be configured to determine that a prize-on frame may be displayed in a next instance of the wagering game that is immediately after the current instance of the wagering game. According to some such implementations, the control system may be configured to determine that the prize-on frame that is displayed in the next instance of the wagering game may be displayed in a predetermined secondary display symbol location. In some examples, the predetermined secondary display symbol location may be adjacent to the predetermined initial display symbol location. According to some examples, the prize-on frame that is displayed in the next instance of the wagering game may match the prize-on frame that is displayed in the current instance of the wagering game.

In some implementations, a display symbol may be randomly selected for a display symbol location in which a prize-on frame is displayed. In some examples, determinations of the game outcome and corresponding display symbols for the instance of the wagering game may be based on one or more random numbers output from a random number generator (RNG). According to some such examples, determining the game outcome and corresponding display symbols for the instance of the wagering game may involve making one or more RNG calls to a game processing backend system.

Still other innovative aspects of the subject matter described in this disclosure can be implemented in a gaming method. The method may involve receiving, via an interface system, user input for initiation of an instance of a slot game. The method may involve determining, via a control system, a game outcome and corresponding display symbols for the instance of the slot game. Determining the game outcome may involve determining whether a game outcome presentation will involve displaying a prize-on frame in one or more predetermined display symbol locations and determining a game outcome award.

The method may involve controlling, via the control system, a display system to display the game outcome. Displaying the game outcome may involve displaying the display symbols at a plurality of display symbol locations on a display device of the display system. The plurality of display symbol locations may be arranged in a plurality of display symbol rows and display symbol columns. For game instances in which it is determined that the game outcome presentation will involve displaying a prize-on frame in one or more predetermined display symbol locations, displaying the game outcome may involve displaying the prize-on frame around one or more of the display symbols in the one or more predetermined display symbol locations. The method may involve controlling, via the control system, the display system to present award effects corresponding to a game outcome award determination.

In some examples, the game outcome presentation may involve displaying a prize-on frame in a predetermined display symbol location and determining the game outcome award may involve determining whether a display symbol presented in the predetermined display symbol location is part of a winning combination of display symbols. If it is determined that the display symbol presented in the predetermined display symbol location is part of the winning combination of display symbols and if the prize-on frame indicates a credit value, determining the game outcome award may involve awarding a credit value corresponding to the credit value indicated on the prize-on frame. If it is determined that the display symbol presented in the predetermined display symbol location is part of the winning combination of display symbols and if the prize-on frame indicates a progressive jackpot, determining the game outcome award may involve awarding a credit value corresponding to a current credit value of the progressive jackpot.

If it was determined that no prize-on frame would be presented for an instance of the wagering game immediately prior to a current instance of the wagering game and the control system determines that a prize-on frame will be displayed during the current instance of the wagering game, in some implementations it may be determined that the prize-on frame can only be displayed in a predetermined initial display symbol location.

Some or all of the operations, functions and/or methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, some innovative aspects of the subject matter described in this disclosure can be implemented in one or more non-transitory media having software stored thereon.

For example, the software may include instructions for controlling one or more devices to perform a gaming method. In some examples, the method may involve receiving, via an interface system, user input for initiation of an instance of a slot game. The method may involve determining, via a control system, a game outcome and corresponding display symbols for the instance of the slot game. Determining the game outcome may involve determining whether a game outcome presentation will involve displaying a prize-on frame in one or more predetermined display symbol locations and determining a game outcome award.

The method may involve controlling, via the control system, a display system to display the game outcome. Displaying the game outcome may involve displaying the display symbols at a plurality of display symbol locations on a display device of the display system. The plurality of display symbol locations may be arranged in a plurality of display symbol rows and display symbol columns. For game instances in which it is determined that the game outcome presentation will involve displaying a prize-on frame in one or more predetermined display symbol locations, displaying the game outcome may involve displaying the prize-on frame around one or more of the display symbols in the one or more predetermined display symbol locations. The method may involve controlling, via the control system, the display system to present award effects corresponding to a game outcome award determination.

In some examples, the game outcome presentation may involve displaying a prize-on frame in a predetermined display symbol location and determining the game outcome award may involve determining whether a display symbol presented in the predetermined display symbol location is part of a winning combination of display symbols. If it is determined that the display symbol presented in the predetermined display symbol location is part of the winning combination of display symbols and if the prize-on frame indicates a credit value, determining the game outcome award may involve awarding a credit value corresponding to the credit value indicated on the prize-on frame. If it is determined that the display symbol presented in the predetermined display symbol location is part of the winning combination of display symbols and if the prize-on frame indicates a progressive jackpot, determining the game outcome award may involve awarding a credit value corresponding to a current credit value of the progressive jackpot.

If it was determined that no prize-on frame would be presented for an instance of the wagering game immediately prior to a current instance of the wagering game and the control system determines that a prize-on frame will be displayed during the current instance of the wagering game, in some implementations it may be determined that the prize-on frame can only be displayed in a predetermined initial display symbol location.

Figure 1:
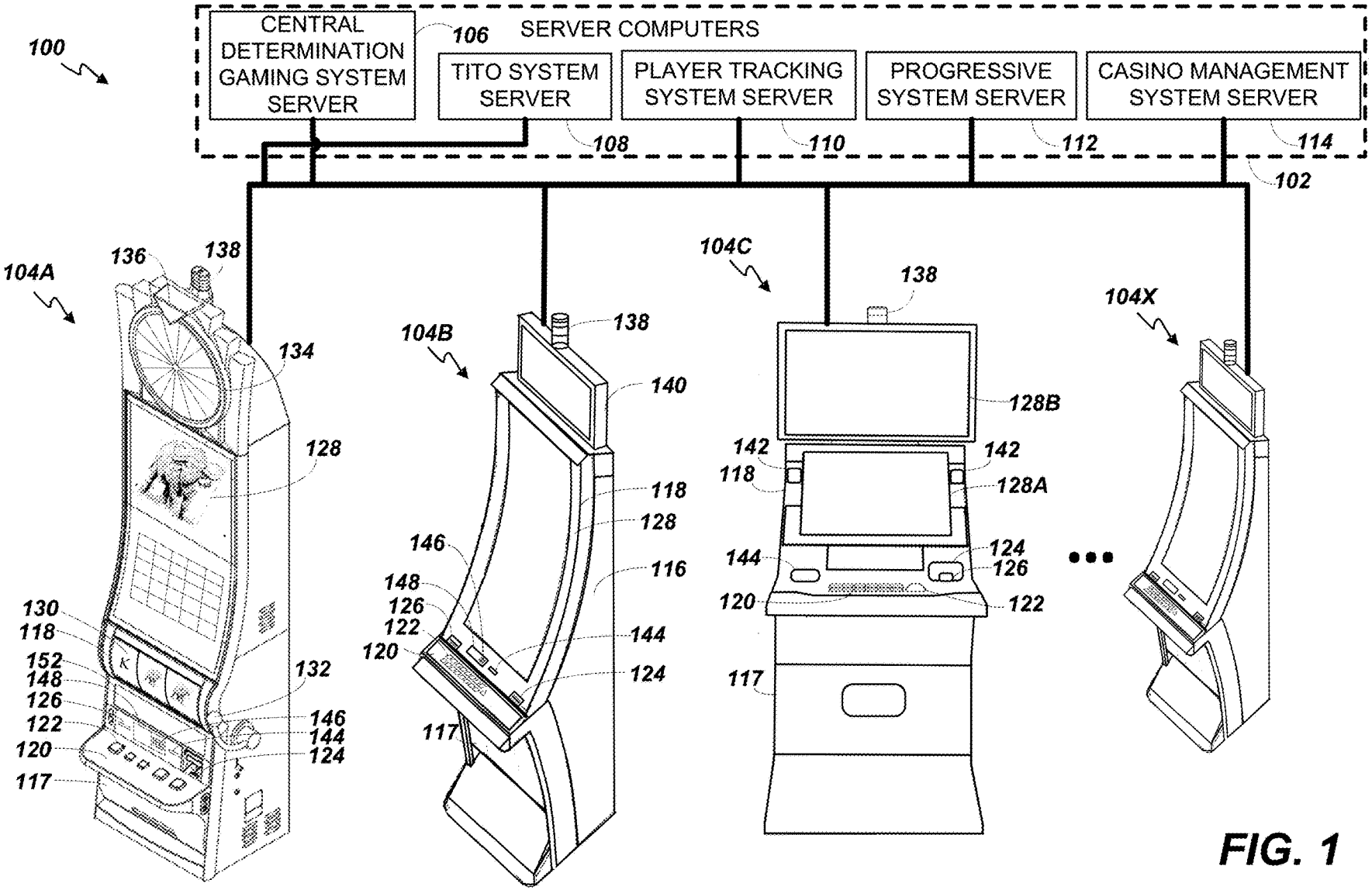
FIG. 1 is an example diagram showing several EGMs networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Some implementations may involve providing a slot game in which the game outcome presentation may involve displaying a prize-on frame in one or more display symbol locations. In some examples, the display symbol locations in which a prize-on frame may be displayed are predetermined display symbol locations, such as locations of one or more particular slot reels. Each of the prize-on frames may be displayed around a display symbol that is selected to be displayed in the display symbol location corresponding to a prize-on frame. If a display symbol corresponding to a prize-on frame is part of a winning combination, a prize indicated on the prize-on frame may be awarded. The prize may, for example, be a particular credit value that is indicated on the prize-on frame, the current value of a particular jackpot that is indicated on the prize-on frame, etc.

Some disclosed implementations may provide potential advantages. One potential advantage is that when a prize-on frame is presented around a particular display symbol, a player's excitement may be enhanced because the player will realize that an additional award may be won if the display symbol is part of a winning combination of display symbols. Another potential advantage is that when a prize-on frame is presented around a particular display symbol, a player can clearly determine what additional award may be won and why the award may be won. This may be more satisfying to a player than obtaining an award for no apparent reason.

Another potential advantage is that in some implementations the possibility that a prize-on frame will be displayed in a particular display symbol location is de-coupled from the possibility that any particular display symbol will be presented in the same display symbol location. This is a potential advantage over previously-deployed games in which a framed symbol was merely one display symbol that could potentially be selected. One associated potential advantage is that in some disclosed implementations, most or all display symbols that could potentially be selected during a game instance could potentially be displayed in the same display symbol location as a prize-on frame. This potential advantage adds variety to the player's experience of the game.

Moreover, there is at least one associated potential technical advantage, in that the number of possible game outcomes that can be presented using the same number of display symbol locations may be greater than those of previously-disclosed games. For example, suppose that in one embodiment of the present disclosure ten different types of prize-on frame could potentially be presented, but only in one display symbol location. As compared to previously-deployed games that use the same numbers of display symbol locations and display symbols, such implementations would increase by a factor of ten the number of possible game outcome presentations. In other words, some disclosed locations have potential advantages in terms of both increased player excitement and a more efficient use of display space.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a web site maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (Wi-Fi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
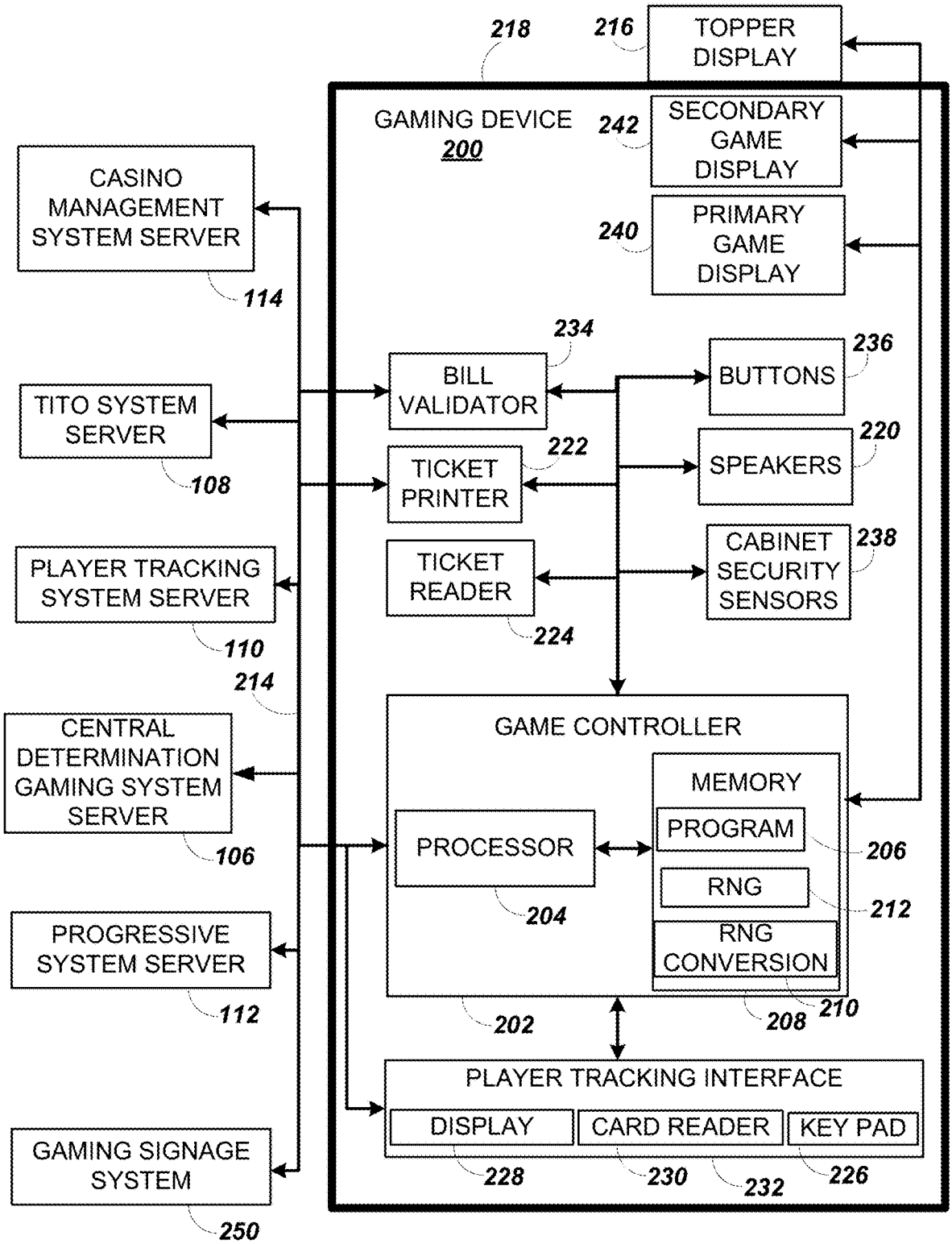
FIG. 2A is a block diagram showing various functional elements of an example EGM.

Many or all the above described components can be controlled by circuitry (e.g., a gaming controller) housed inside the main cabinet 116 of the gaming device 104A, the details of which are shown in FIG. 2A.

An alternative example gaming device 104B illustrated in FIG. 1 is the Arc model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2A also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. Game developers could vary the degree of true randomness for each RNG (e.g., pseudorandom) and utilize specific RNGs depending on game requirements.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). FIG. 2A illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2A are examples to facilitate ease of description and explanation.

Figure 2B:
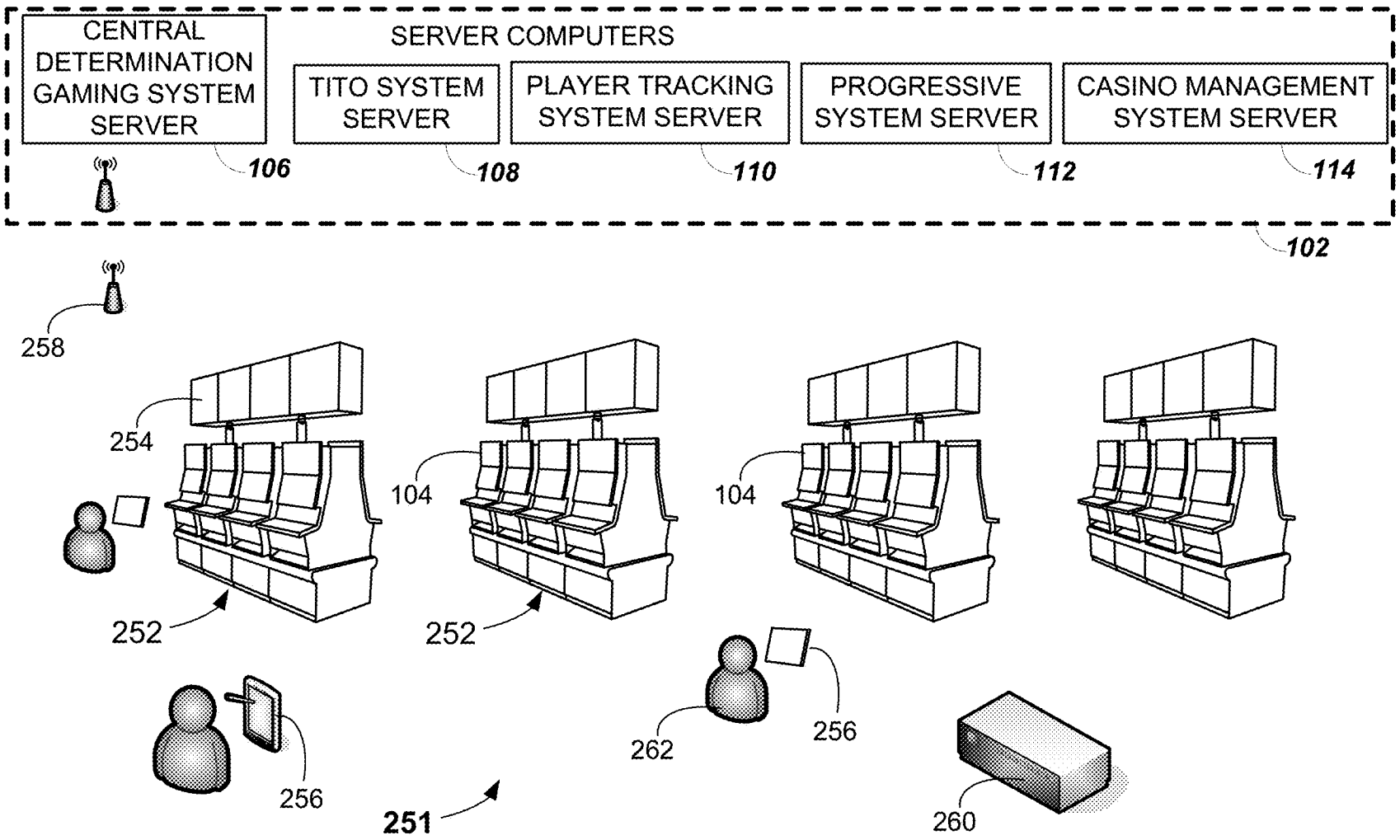
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
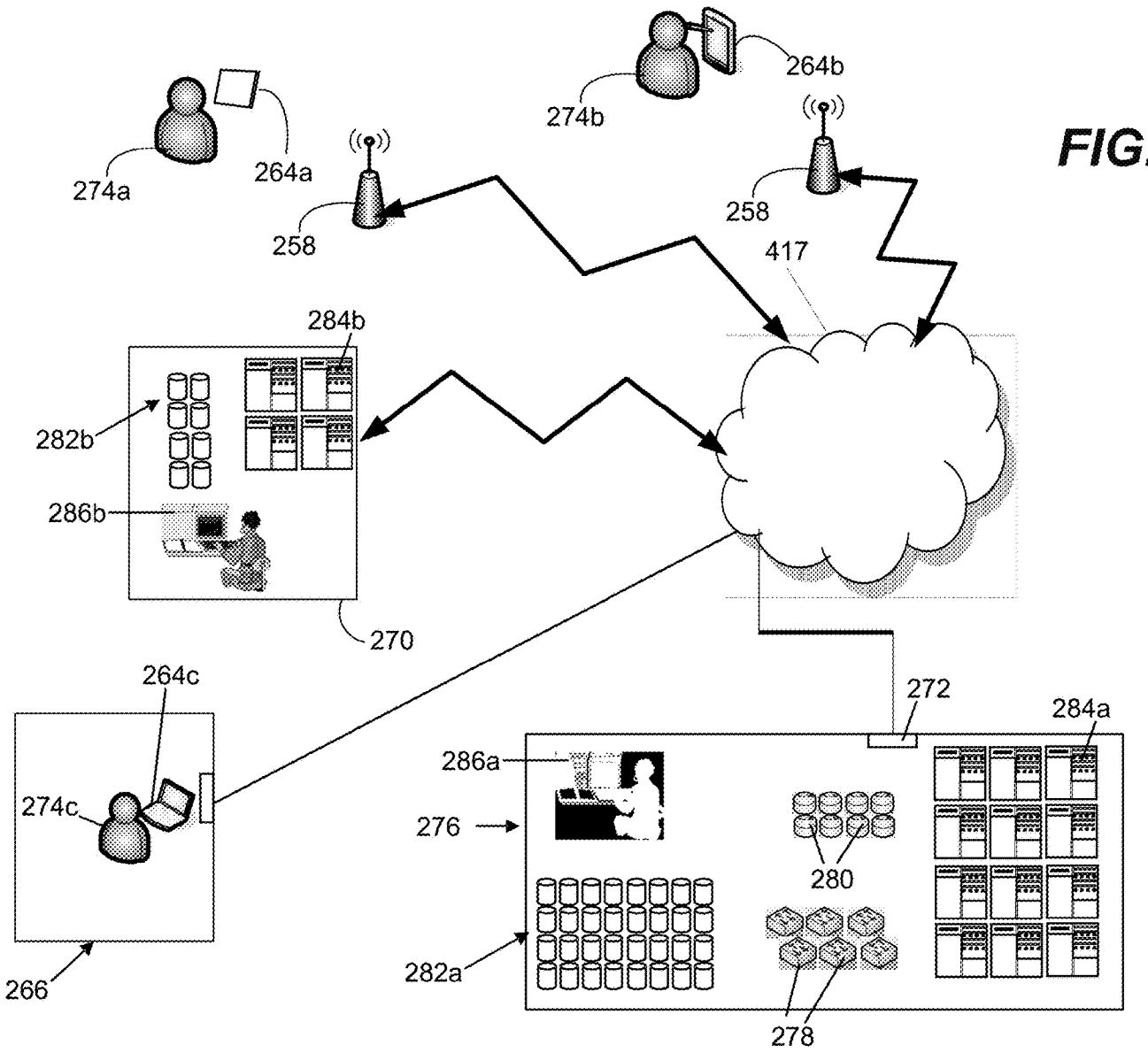
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG.

2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
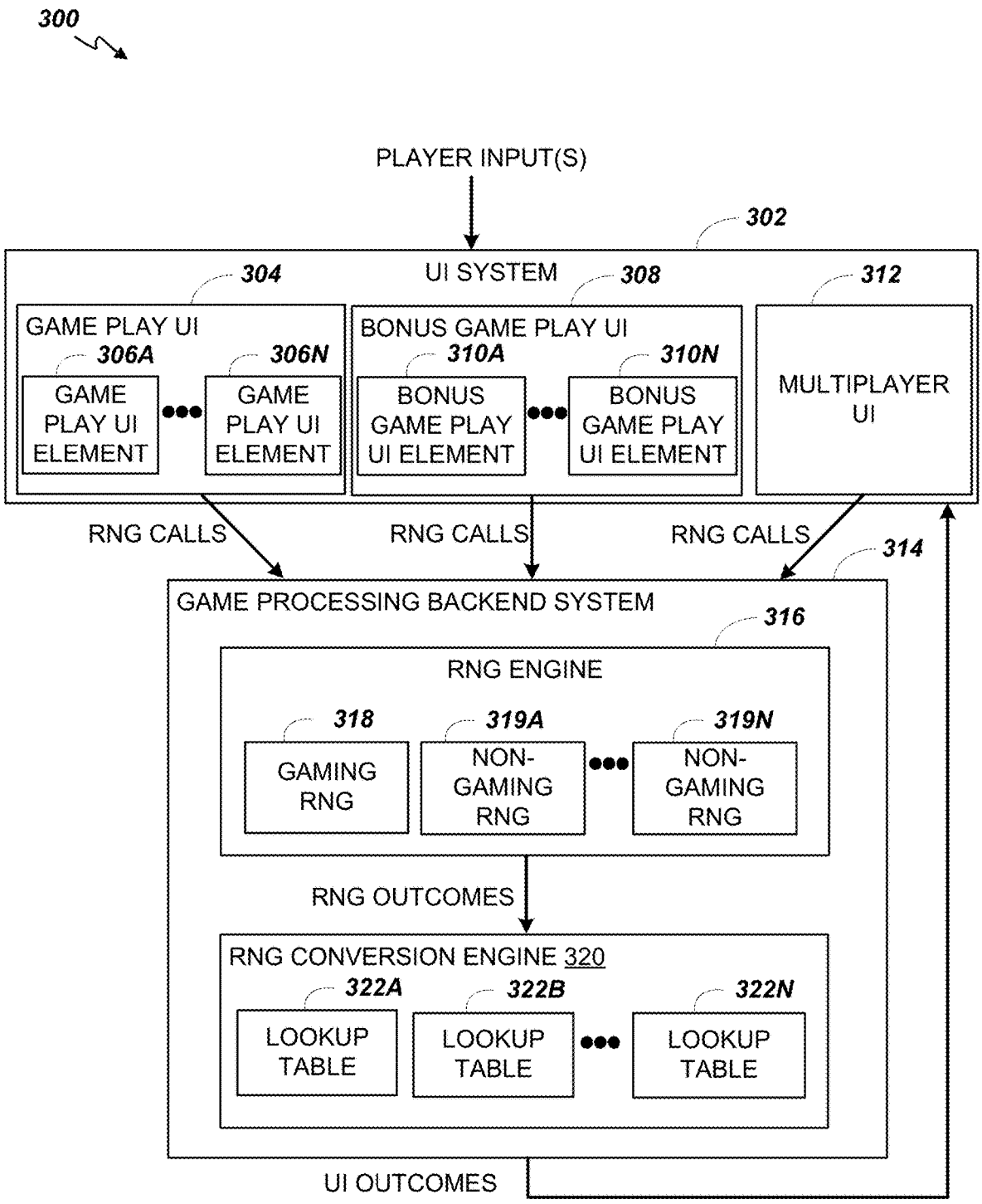
FIG. 3 illustrates, in block diagram form, an embodiment of a game processing architecture that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2A, respectively. Alternatively, portions of the gaming processing architecture 300 can implement the game processing pipeline using a gaming device and one or more remote gaming devices, such as central determination gaming system server 106 shown in FIG. 1. In some such examples, the game processing pipeline may include a gaming device and one or more servers 284*a* of the gaming data center 276 shown in FIG. 2C. According to some such implementations, the gaming device may be a mobile device such as described above with reference to FIG. 2B or an EUD as described above with reference to FIG. 2C.

The UI system 302 includes one or more UIs that a player can interact with. The UI system 302 could include one or more game play UIs 304, one or more bonus game play UIs 304, and one or more multiplayer UIs 306, where each UI type includes one or more mechanical UIs and/or graphical UIs (GUIs). In other words, game play UI 304, bonus game play UI 304, and the multiplayer UI 304 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from to the bonus game play UI elements 310A-310N.

FIG. 3 also illustrates that UI system 302 could include a multiplayer UI 312 purposed for game play that differ or is separate from the typical base game. For example, multiplayer UI 302 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for such as generating random messages that appear on the gaming device. The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome to the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

FIG. 3 shows examples of lookup tables 322A . . . 322N, which are also called weighted tables. In general, a weighted table can be implemented as any data structure that assigns probabilities to different options, in order for one of the different options to be selected using a random number. Different options are represented in different entries of a weighted table. The probabilities for different options can be reflected in threshold values (e.g., 1<RND<=40 for option 1, 40<RND<=70 for option 2, 70<RND<=90 for option 3, and 90<RND<=100 for option 4, given four options and a random number RAID where 0<RND<=100). The threshold values can represent percentages or, more generally, subranges within the range for a random number. In some example implementations, the threshold values for a weighted table are represented as count values for the respective entries of the weighted table. For example, the following table shows count values for the four options described above:

TABLE 1

Example Weighted Table

| count value | entry |
|---|---|
| 40 | <value a1, value a2, . . . > |
| 30 | <value b1, value b2, . . . > |
| 20 | <value c1, value c2, . . . > |
| 10 | <value d1, value d2, . . . > |

The sum total of the count values indicates the range of the options. Control logic can use a random number, generated between 1 and the sum total of the count values, to select one of the entries in the weighted table by comparing the random number to successive running totals. In the example shown in Table 1, if the random number is 40 or less, the first entry is selected. Otherwise, if the random number is between 41 and 70, the second entry is selected. Otherwise, if the random number is between 71 and 90, the third entry is selected. Otherwise, the last entry is selected.

The threshold values for a weighted table can be fixed and pre-determined. Or, the threshold values for a weighted table can vary dynamically (e.g., depending on bet level). Or, a weighted table can be dynamically selected (e.g., depending on bet level) from among multiple available weighted tables. Different parameters or choices during game play can use different weighted tables. Or, different combinations of parameters or choices can be combined in entries of a given weighted table.

According to some examples, the example game processing architecture 300 shown in FIG. 3 can be used to process game play instructions and generate outcomes as shown and described herein. In response to user input received via an interface system for initiation of an instance of a wagering game (e.g., an indication of user input from a "play" button), the game play UI 304 may make one or more RNG calls to the game processing backend system 314 for determining a game outcome and corresponding display symbols for the instance of the wagering game. According to some examples, the wagering game may be a slot game.

In some instances, the one or more RNG calls may include an RNG call to determine whether a game outcome presentation will involve displaying a prize-on frame in one or more display symbol locations, which may in some instances be predetermined display symbol locations. In some such examples, there may be at least one RNG call involving whether a prize-on frame will be presented in one or more display symbol locations that is separate from the RNG call(s) for determining the game outcome and corresponding display symbols for the instance of the wagering game. According to some implementations, the one or more RNG calls for determining the game outcome and corresponding display symbols for the instance of the wagering game may include an RNG call to determine whether a display symbol presented in a display symbol location in which a prize-on frame will be presented is part of a winning combination of display symbols. According to some examples, the one or more RNG calls may include an RNG call to determine a game outcome award that involves a prize-on frame.

In response, the backend system 314 may perform various operations. Using a gaming RNG 318, the RNG engine 316 may generate one or more random numbers, which may be passed to the RNG conversion engine 320. The RNG conversion engine 320 may use the one or more random numbers (along with one or more of the lookup tables 322A-322N) to determine symbol stop positions for the active reels. The RNG conversion engine 320 may use one or more other random numbers (along with one or more of the lookup tables 322A-322N) to determine whether a game outcome presentation will involve displaying a prize-on frame in one or more predetermined display symbol locations. The backend system 314 may also determine the outcome of the process (e.g., calculating whether any win conditions exist on pay lines, whether a display symbol presented in a display symbol location in which a prize-on frame will be presented is part of a winning combination of display symbols, a corresponding award, etc.).

In some instances, the RNG conversion engine 320, using one or more of the random number(s) and one or more of the lookup tables 322A . . . 322N, may select a UI outcome for a game outcome presentation in which a prize-on frame will be displayed in one or more predetermined display symbol locations. According to some such examples, the RNG conversion engine 320 may determine that the UI outcome for a slot game includes a display symbol corresponding with a prize-on frame is part of a winning combination of display symbols. In some such examples, the RNG conversion engine 320 may determine that the UI outcome for a slot game includes a presentation of a game outcome award that involves a prize-on frame.

Figure 4:
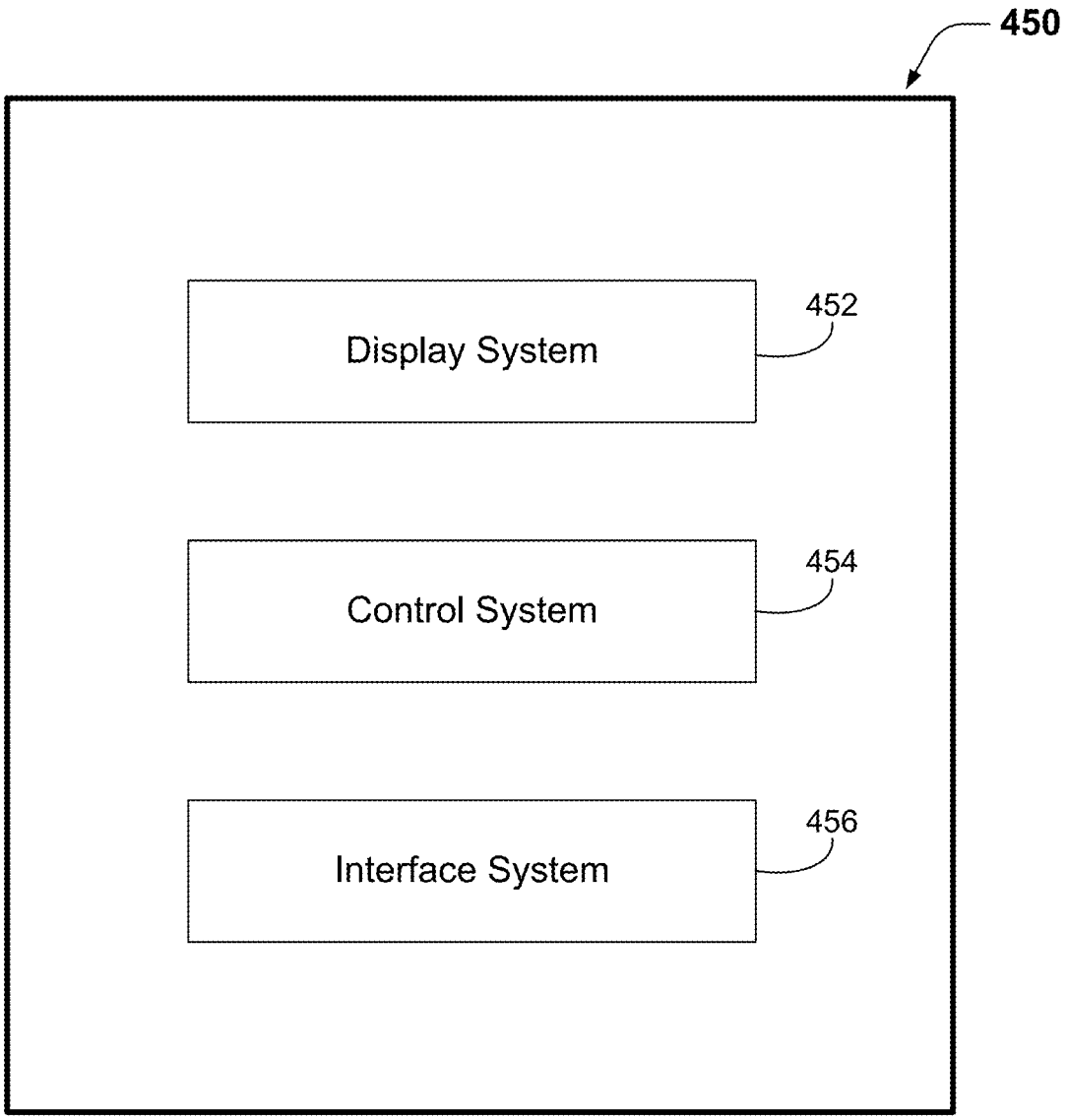
FIG. 4 is a block diagram that shows blocks of an apparatus according to one example.

FIG. 4 is a block diagram that shows blocks of an apparatus according to one example. According to some examples, the apparatus 450 may be, or may include, a gaming device. In some examples, the apparatus 450 may be an EGM such as those described above with reference to FIGS. 1 and 2A. However, in alternative examples, the apparatus 450 may be a mobile device such as described above with reference to FIG. 2B or an EUD as described above with reference to FIG. 2C.

In this example, the apparatus 450 includes a display system 452 and a control system 454 that is configured to communicate with the display system 452. In this example, the control system 454 is configured to communicate with the display system 452 via wired communication, e.g., via electrical signals. In alternative implementations, the control system 454 may be configured to communicate with the display system 452 via wireless communication. Accordingly, at least a portion of the control system 454 may be coupled to the display system 452. As used herein, the term "coupled to" has a meaning that could include being physically coupled for wired communication or being configured for wireless communication.

The control system 454 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 456 is shown as being separate from the control system 454, in some implementations the interface system 456 may be part of the control system 454. In some implementations, the interface system 456 may include the entire control system 454. The control system 454 also may include (and/or be configured for communication with) one or more memory devices, such as one or more random access memory (RAM) devices, read-only memory (ROM) devices and/or other types of non-transitory media. In some implementations, at least a portion of the control system 454 may be implemented as a register. Accordingly, the apparatus 450 may have a memory system that includes one or more memory devices, though the memory system is not shown in FIG. 4.

The control system 454 may be capable of performing, at least in part, the methods disclosed herein. In some examples, the control system 454 may be capable of performing at least some of the methods described herein according to instructions (e.g., software) stored on one or more non-transitory media. For example, the control system 454 may be configured for controlling the display system 452 and/or for receiving and processing data from at least a portion of the display system 452, e.g., as described below.

The display system 452 may include, one or more liquid crystal displays (LCDs), plasma displays, light-emitting diode (LED) displays, microLED displays or organic light-emitting diode (OLED) displays. According to some implementations, the display system 452 may include at least one flexible display, such as a flexible OLED. Although shown as separate components in FIG. 4, the display system 452 may, in some examples, include at least a portion of the control system 454. For example, the display system 452 may include one or more processors, microprocessors, programmable logic devices, discrete gates or transistor logic, etc.

In the example shown in FIG. 4, the apparatus 450 includes an interface system 456. In some examples, the interface system may include a wireless interface system. In some implementations, the interface system 456 may include a network interface, an interface between the control system 454 and the display system 452, an interface between the control system 454 and a memory system and/or an interface between the control system 454 and an external device interface (e.g., a port or an applications processor). In some examples, the interface system 456 may include one or more user interfaces, such as a touch screen, one or more buttons, a gesture recognition system, a voice recognition system, etc.

According to some implementations, the apparatus 450 may be a single device, whereas in other implementations the apparatus 450 may be a system that includes more than one device. Accordingly, the terms "apparatus" and "system" may sometimes be used interchangeably herein. In other examples, the apparatus 450 may be a component of another device. For example, in some implementations at least a portion of the display system 452 and/or the control system 454 may be included in more than one apparatus. For example, in some implementations at least part of the control system 454 may reside in a server, such as a central determination server or a gaming data center server. Some implementations of the apparatus 450 may not include a display system. In some such implementations, the control system 454 may be configured for controlling the display system of another device.

Figure 5:
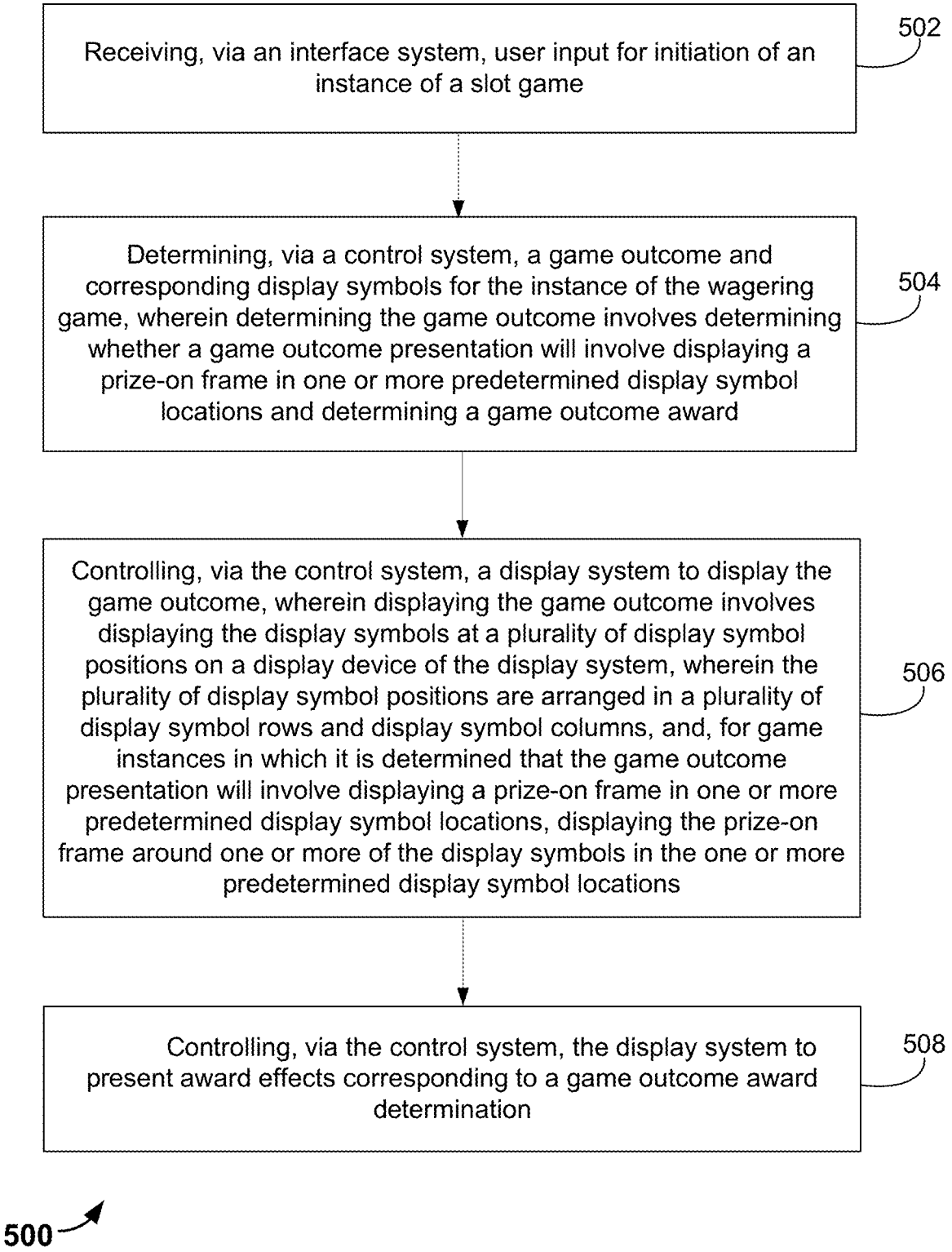
FIG. 5 is a flow diagram that shows blocks of a method according to one example.

FIG. 5 is a flow diagram that shows blocks of a method according to one example. In some examples method 500 may be performed, at least in part, by an apparatus such as that described above with reference to FIG. 4. In some examples, the method 500 may be performed, at least in part, by a control system (e.g., the control system 454 of FIG. 4) according to software stored upon one or more non-transitory storage media. According to some examples the method 500 may be performed, at least in part, by a server, such as a central determination server or a gaming data center server.

As with other methods described herein, the number and sequence of blocks shown in FIG. 5 are merely examples. Similar disclosed methods may include more or fewer blocks. Moreover, at least some of the blocks may occur in a different sequence than the sequence that is shown in a flow diagram.

According to this example, block 502 involves receiving, via an interface system, user input for initiation of an instance of a slot game. For example, the user input may be received by the control system 454 of FIG. 4, via a user interface of the interface system 456. Block 502 may, for example, involve receiving an indication that a user has pressed a "play" button of a gaming device, receiving an indication that the user has touched an area of a touch screen that corresponds to a displayed image of a "play" button, etc. In some such implementations, block 502 (or a preceding block of method 500) may involve verifying that there is sufficient credit for at least one instance of a game. According to some such implementations, the gaming device may include apparatus for receiving monetary credit.

According to this implementation, block 504 involves determining, via a control system, a game outcome and corresponding display symbols for the instance of the wagering game. In this example, block 504 involves determining a game outcome award. In some such examples, block 504 may involve determining the slot game outcome and corresponding display symbols via a control system of a gaming device. According to some such examples, both the UI system 302 and the game processing backend system 314 that are described above with reference to FIG. 3 may reside in a single gaming device.

In other examples, the determination of block 504 may be made, at least in part, by a server. According to some such examples, the server may determine both the slot game outcome and the corresponding display symbols. According to some such examples, both the UI system 302 and the game processing backend system 314 may reside in a single device, such as a single server.

In some examples, one device (e.g., a server) may determine at least a portion of the slot game outcome (e.g., a particular number of credits to be awarded, a particular number of configurable symbols that will be presented, etc.) and another device (e.g., a local gaming device on which a game is being presented) may determine the display symbols corresponding to the outcome obtained from the server. In some such examples, the UI system 302 may reside in one device and the game processing backend system 314 may reside in another device. According to some alternative examples, one server may implement at least a portion of the UI system 302 and another server may implement the game processing backend system 314.

According to some examples, determining the game outcome involves determining whether a game outcome presentation will involve displaying a prize-on frame in one or more display symbol locations. The prize-on frame(s) may, in some instances, include letters, numbers and/or symbols that indicate one or more types of jackpots, specific credit amounts to be awarded, multiplier symbols, wild symbols or other reel modification symbols, etc. For example, in some instances the prize-on frame may include a wild symbol which, when the frame surrounds a symbol part of a winning combination of symbols, replaces each of the symbols in the winning combination of symbols with a wild symbol. These new wild symbols may then create additional winning combinations of symbols. In some instances the player may be receive a first award for the first winning symbol combination, and then may be receive a second award for any subsequent winning symbol combinations created with the new wild symbols.

The one or more display symbol locations may, in some examples, be one or more predetermined display symbol locations. The predetermined display symbol location may, in some examples, be one of the display symbol locations of a predetermined display symbol column and/or one of the display symbol locations of a predetermined display symbol row. According to some such implementations, a prize-on frame will only be displayed in a predetermined display symbol column and/or a predetermined display symbol row. However, in alternative examples a prize-on frame may be displayed in any display symbol location.

For example, block 504 may involve making one or more RNG calls to determine whether a game outcome presentation will involve displaying a prize-on frame in one or more display symbol locations, which may in some instances be one or more predetermined display symbol locations. In some such examples, there may be at least one RNG call involving whether a prize-on frame will be presented in one or more display symbol locations that is separate from the RNG call(s) for determining the game outcome and corresponding display symbols for the instance of the wagering game. In other words, in some implementations determining whether a prize-on frame will be presented in one or more display symbol locations may involve one or more processes that are separate from the process(es) for determining the game outcome and corresponding display symbols.

In some implementations, if the control system determined that no prize-on frame would be presented for an instance of the wagering game and then, during an instance of the wagering game immediately after that instance of the wagering game the control system had determined that a prize-on frame would be presented, the prize-on frame will be displayed again in at least one additional subsequent game instance. Some examples are described below with reference to FIG. 6 et seq. In some such examples, the prize-on frame will first be presented in a first predetermined display symbol location.

According to some such examples, during the next instance of the wagering game, the same prize-on frame will then be presented in a second predetermined display symbol location. In some such examples, if a prize-on frame is first presented in a first predetermined display symbol location, it is predetermined that the same prize-on frame will be presented in the second predetermined display symbol location during the next instance of the wagering game. According to some such implementations, the same prize-on frame will first be presented in a first predetermined display symbol location and will subsequently be presented in a predetermined sequence of display symbol locations. Accordingly, no RNG call is required to determine the type or placement of the prize-on frame in such instances. However, one or more RNG calls may nonetheless be made to determine whether another prize-on frame will be displayed in another display symbol location, such as a first predetermined display symbol location.

In some implementations, the same prize-on frame may be presented in the same display symbol location during multiple instances of the wagering game. According to some such examples, the same prize-on frame may be presented in the first display symbol location during multiple instances of the wagering game. In other such examples, the same prize-on frame will first be presented in a first predetermined a display symbol location and will subsequently be presented in another display symbol location during multiple instances of the wagering game.

According to some such implementations, the same prize-on frame will first be presented in a first predetermined display symbol location and will subsequently be presented in a predetermined sequence of display symbol locations. However, in some implementations, after being presented in the predetermined sequence of display symbol locations the prize-on frame may be presented in the same display symbol location during multiple instances of the wagering game. In some such examples, the prize-on frame may be presented in the same display symbol location until a display symbol presented in the same display symbol location is part of a winning combination of display symbols.

According to some such implementations, a first prize-on frame may be presented in a first display symbol location during multiple instances of the wagering game while a second prize-on frame is presented in a predetermined sequence of display symbol locations. In some such examples, the predetermined sequence of display symbol locations may include the first display symbol location.

According to some such examples, if it is determined that the first prize-on frame and the second prize-on frame will be presented in the same display symbol location, a single prize-on frame will be presented in that display symbol location. The single prize-on frame may, for example, indicate the value of the first prize-on frame or the value of the second prize-on frame. According to some such implementations, the single prize-on frame may indicate the higher of the two values. According to some such examples, if it is determined that the first prize-on frame and the second prize-on frame will be presented in the same display symbol location, a new prize-on frame may be presented at that location. The new prize-on frame may have a value different from that of the first prize-on frame or the second prize-on frame. For example, the new prize-on frame may have a value that is a multiple of the value of the first prize-on frame or the value of the second prize-on frame. In another example, the new prize-on frame may have a value that is a sum of the value of the first prize-on frame and the value of the second prize-on frame. In another example, the new prize-on frame may have a value that is the product of the value of the first prize-on frame and the value of the second prize-on frame. For example, if the value of the first prize-on frame were 50 and the value of the second prize-on frame were 100, the new prize-on frame may have a value of 5,000.

In some examples wherein it is determined that a prize-on frame will be presented in a display symbol location, determining the game outcome award may involve determining whether a display symbol presented in the same display symbol location is part of a winning combination of display symbols. According to some such examples, the value or other indication of the prize-on frame will affect an award that is based on the winning combination of display symbols. In some such examples, the prize-on frame may indicate a credit value. Determining the game outcome award may involve awarding a credit value corresponding to the credit value indicated on the prize-on frame. In other such examples, the prize-on frame may indicate a progressive jackpot. Determining the game outcome award may involve awarding a credit value corresponding to a current credit value of the progressive jackpot. In other instances, the prize-on frame may indicate a multiplier symbol, such as "2×," "3×," etc. In some examples, determining the game outcome award may involve awarding a credit value corresponding to a multiple of a credit value that would otherwise have been awarded for the winning combination of display symbols. According to some examples, a prize award may be aligned with a changing payline. According to some such examples, the payline may change with each reel spin.

According to some implementations, the value of at least one type of prize-on frame may depend, at least in part, on a current wager level. In some such implementations, the user interface system may be configured for receiving an indication of a wager amount. According to some such implementations, in response to receiving the indication of the determined wager amount, a control system (e.g., a control system of a gaming device) may be configured to determine a corresponding increase in a value of at least one prize-on frame. In some such implementations, in response to receiving the indication of the determined wager amount, the control system may be configured to determine that at least one jackpot will become available. The availability of the jackpot may correspond with the availability of a prize-on frame indicating the jackpot. According to some such implementations, the control system may be configured to control the display system to provide an indication that the at least one jackpot has become available and/or that a prize-on frame indicating the jackpot has become available.

In this example, block 506 involves controlling, via the control system, a display system to display the game outcome. According to this example, displaying the game outcome involves displaying the display symbols at a plurality of display symbol locations on a display device of the display system. In this implementation, the plurality of display symbol locations are arranged in a plurality of display symbol rows and display symbol columns. However, in other examples, the display symbol locations may be arranged in other ways, e.g., along curves, in lines that radiate from one or more central areas, etc.

In this example, for game instances in which it is determined that the game outcome presentation will involve displaying a prize-on frame in one or more predetermined display symbol locations, block 506 involves displaying the prize-on frame around one or more of the display symbols in the one or more predetermined display symbol locations. Various examples are described below with reference to FIG. 6 et seq.

According to this implementation, block 508 involves controlling, via the control system, the display system to present award effects corresponding to a game outcome award determination. In this example, the game outcome award determination corresponds to the game outcome award that is determined in block 504.

In some implementations of method 500, the prize-on frame may indicate one or more free games, such as "2 Free Games," "3 Free Games," etc. According to some such implementations, if a winning combination of display symbols includes a display symbol presented at the same display symbol location as a prize-on frame that indicates one or more free games, block 508 (or a subsequent block of method 500) may involve presenting a visual and/or audio indication that a player has won the one or more free games, presenting the one or more free games, etc.

Figure 6:
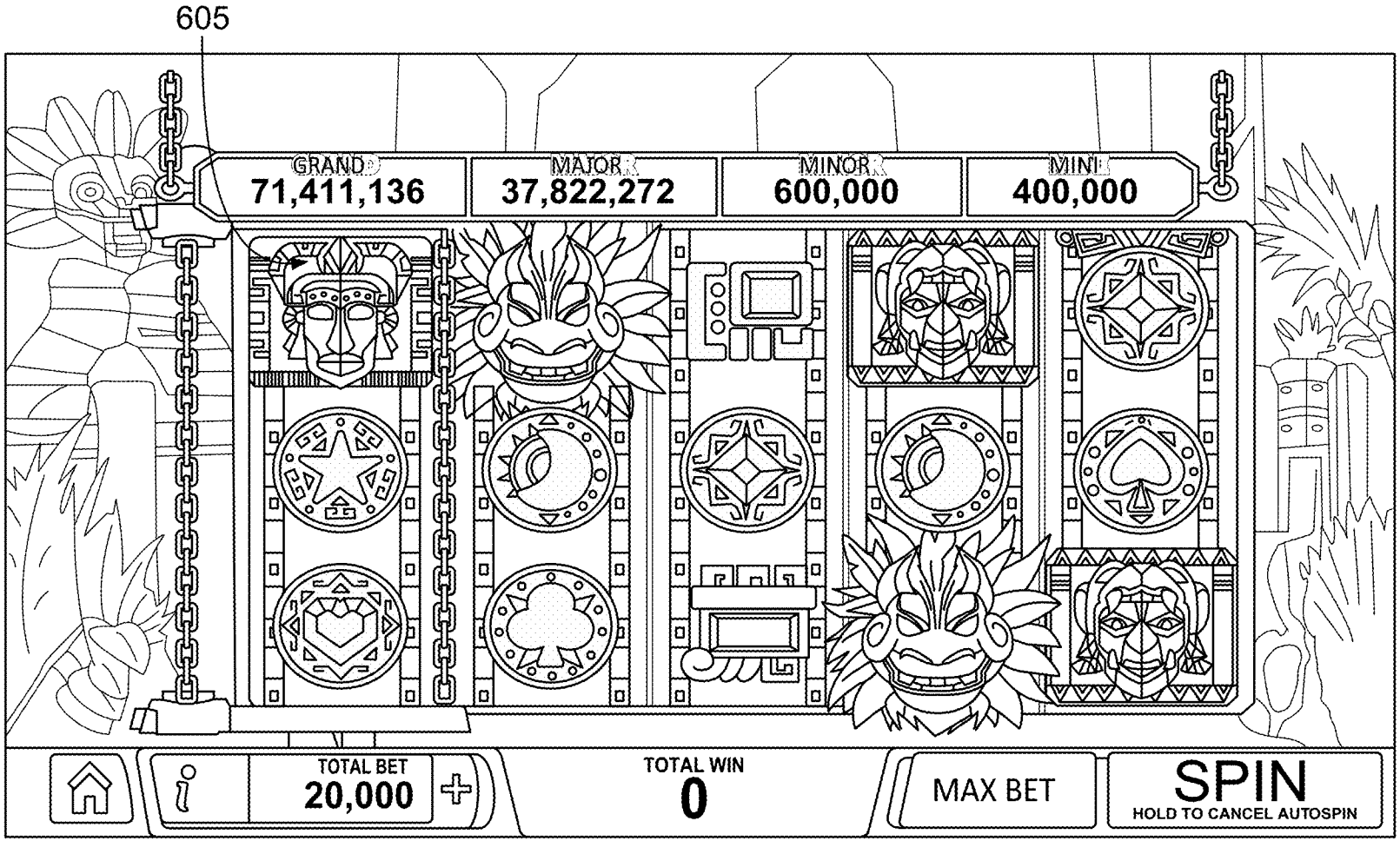
FIG. 6 shows an example of a display that may be presented according to one implementation of the method of FIG. 5.

FIG. 6 shows an example of a display that may be presented according to one implementation of the method of FIG. 5. As with other implementations provided herein, the particular types of elements and the particular arrangement of elements shown in FIG. 6 are merely examples.

In this example, the display 600 is an example of a GUI that may be used to present instances of an Aztec-themed wagering game. In some instances, the display 600 may be used to present an online wagering game, e.g., on an end user device (EUD) such as one of the EUDs 264*a*, 264*b* or 264*c* shown in FIG. 2C and described above. However, in alternative implementations the display 600 may be used to present a casino-based wagering game, e.g., on a gaming device such as one of the gaming devices 104A-104X that are shown in FIG. 1.

According to this example, displaying the game outcome shown in FIG. 6 involves displaying display symbols at a plurality of display symbol locations. In this implementation, the plurality of display symbol locations are arranged in a plurality of display symbol rows and display symbol columns. In the particular game outcome shown in FIG. 6, it was determined in block 504 that the game outcome presentation would not involve displaying a prize-on frame in one or more predetermined display symbol locations.

In this example, a prize-on frame can only be presented in one of the display symbol locations of the column 605. The display symbol locations of the column 605 are examples of the "predetermined display symbol locations" that are disclosed herein. In other implementations, a prize-on frame may be presented in other display symbol locations, such as one or more other display symbol rows or display symbol columns. In still other examples, a prize-on frame may be presented in any display symbol location.

Figure 7:
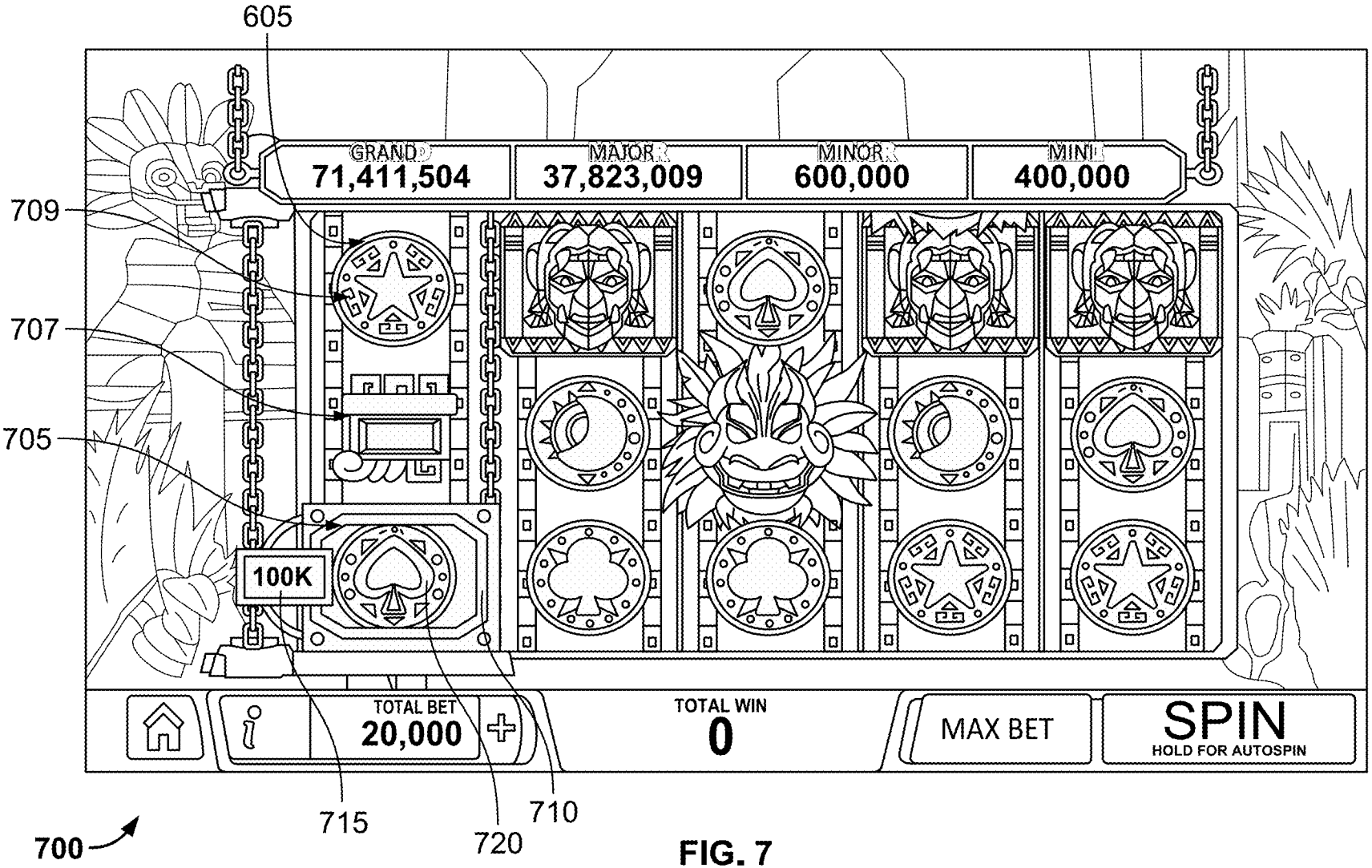
FIG. 7 shows an example of a display that may be presented after the display of FIG. 6 according to some examples.

FIG. 7 shows an example of a display that may be presented after the display of FIG. 6 according to some examples. According to this example, the display 700 is an example of a game outcome presentation that may be displayed during the next game instance after the game instance that is represented in FIG. 6. In this instance, it was determined in block 504 that the game outcome presentation would include a prize-on frame displayed in a predetermined display symbol location.

The game instance that is depicted in FIG. 7 is an example in which a control system (such as the control system 454 shown in FIG. 4) determined that no prize-on frame would be presented for an instance of the wagering game immediately prior to a current instance of the wagering game and in which the control system determines that a prize-on frame will be displayed during the current instance of the wagering game. According to this example, the control system is configured to determine that the prize-on frame can only be displayed in a predetermined initial display symbol location. In this example, the predetermined initial display symbol location is column 605, row 705. According to some such examples, if no prize-on frame was presented for the instance of the wagering game that was immediately prior to the current instance of the wagering game, column 605, row 705 is the only display symbol location in which a prize-on frame could be presented. In other words, column 605, row 705 is the only predetermined initial display symbol location in such examples. In other examples, a prize-on frame could initially be presented in any row of column 605, including row 707 and row 709. According to other implementations, a prize-on frame could initially be presented in any row of any column.

According to this example, the prize-on frame 710 indicates a credit value in the prize area 715. In this implementation, if a game outcome includes a winning combination of symbols that includes a symbol in the same position as the prize-on frame 710 (which is the symbol 720 in this example) a credit value of 100,000 will be awarded. In this particular instance, no winning combination of symbols included the symbol 720.

According to some such examples, if a control system has determined that a prize-on frame will be presented in a predetermined initial display symbol location during a current instance of a wagering game, the control system may be configured to determine that a prize-on frame will be displayed in a next instance of the wagering game that is immediately after the current instance of the wagering game. In some such examples, there is a predetermined outcome to the process of determining whether the game outcome presentation will involve displaying a prize-on frame: according to some such examples, it may be predetermined that the same prize-on frame will be presented in as part of the game outcome of the next game instance. In other words, according to some such examples the process of determining whether the game outcome presentation will involve displaying the same prize-on frame will not involve an RNG call. This is another potential technical advantage. According to some such implementations, the prize-on frame that is displayed in the next instance of the wagering game may be displayed in a predetermined secondary display symbol location. The predetermined secondary display symbol location may or may not be adjacent to the predetermined initial display symbol location, depending on the particular implementation. According to some such implementations, the prize-on frame that is displayed in the next instance of the wagering game will match the prize-on frame that was displayed in the previous instance of the wagering game.

Figure 8:
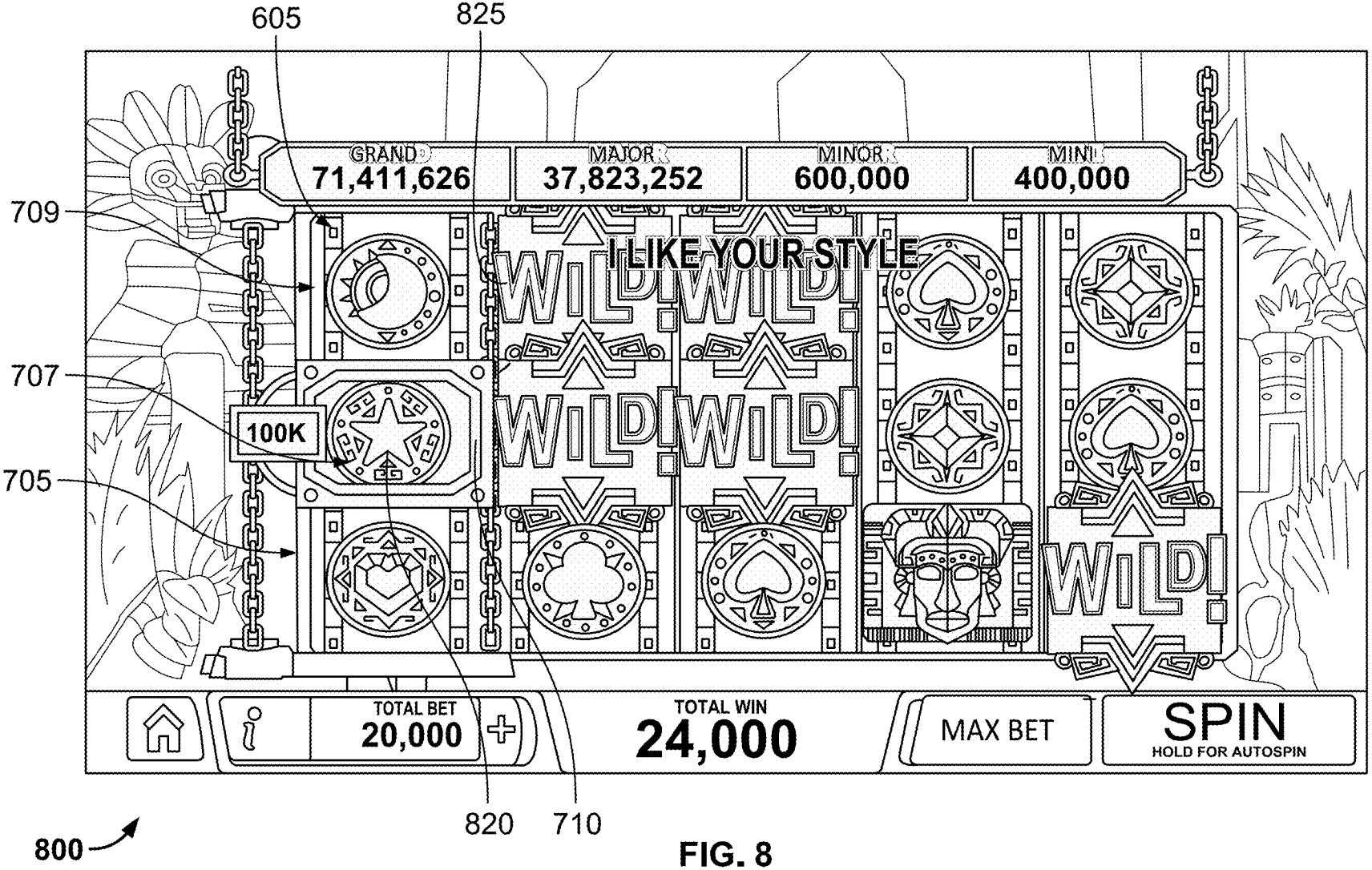
FIG. 8 shows an example of a display that may be presented after the display of FIG. 7 according to some examples.

FIG. 8 shows an example of a display that may be presented after the display of FIG. 7 according to some examples. According to this example, the display 800 is an example of a GUI that may be presented for the next game instance after the game instance depicted in FIG. 7.

According to this example, because a prize-on frame was presented in a predetermined initial display symbol location in the game outcome indicated in FIG. 7, in the next instance of the wagering game the same prize-on frame (710) shown in FIG. 7 will be displayed in a predetermined secondary display symbol location. In this example, the predetermined secondary display symbol location is column 605, row 707, which is adjacent to the initial display symbol location. According to some such implementations, a series of images that depict the prize-on frame 710 being raised from column 605, row 705 to column 605, row 707 may be presented. In some such implementations, corresponding sounds, which may include clinking sounds corresponding to movement of the chains 825, may be presented.

However, the process of determining whether the game outcome presentation will involve displaying one or more other prize-on frames may nonetheless involve one or more RNG calls. In this example, the process of determining whether the game outcome presentation will involve displaying a prize-on frame in the display symbol location of column 605, row 705 involved one or more RNG calls. In this particular instance, it was determined in block 504 that no prize-on frame would be presented in the display symbol location of column 605, row 705.

In this implementation, even though it was predetermined that the same prize-on frame 710 would be displayed in the predetermined secondary display symbol location, block 504 nonetheless included a process of randomly determining (e.g., via one or more RNG calls) the game outcome and corresponding display symbols for the instance of the wagering game that is shown in FIG. 8. Accordingly, the prize-on frame 710 is now in the same display symbol location as a different symbol, the display symbol 820. In this particular instance, there was a game outcome award of 24,000 credits. However, no winning combination of symbols included the symbol 820, so the credit shown on the prize-on frame 710 was not included in this award.

According to some such examples, if a control system has determined that a prize-on frame will be presented in a predetermined secondary display symbol location during a current instance of a wagering game, the control system may be configured to determine that a prize-on frame will be displayed in a next instance of the wagering game that is immediately after the current instance of the wagering game. In some such examples, it may be predetermined that a prize-on frame will be presented in as part of the game outcome of the next game instance. In other words, according to some such examples the process of determining whether the game outcome presentation will involve displaying the same prize-on frame will not involve an RNG call. This is another potential technical advantage. According to some such implementations, the prize-on frame that is displayed in the next instance of the wagering game may be displayed in a predetermined tertiary display symbol location. The predetermined tertiary display symbol location may or may not be adjacent to the predetermined secondary display symbol location, depending on the particular implementation.

Figure 9A:
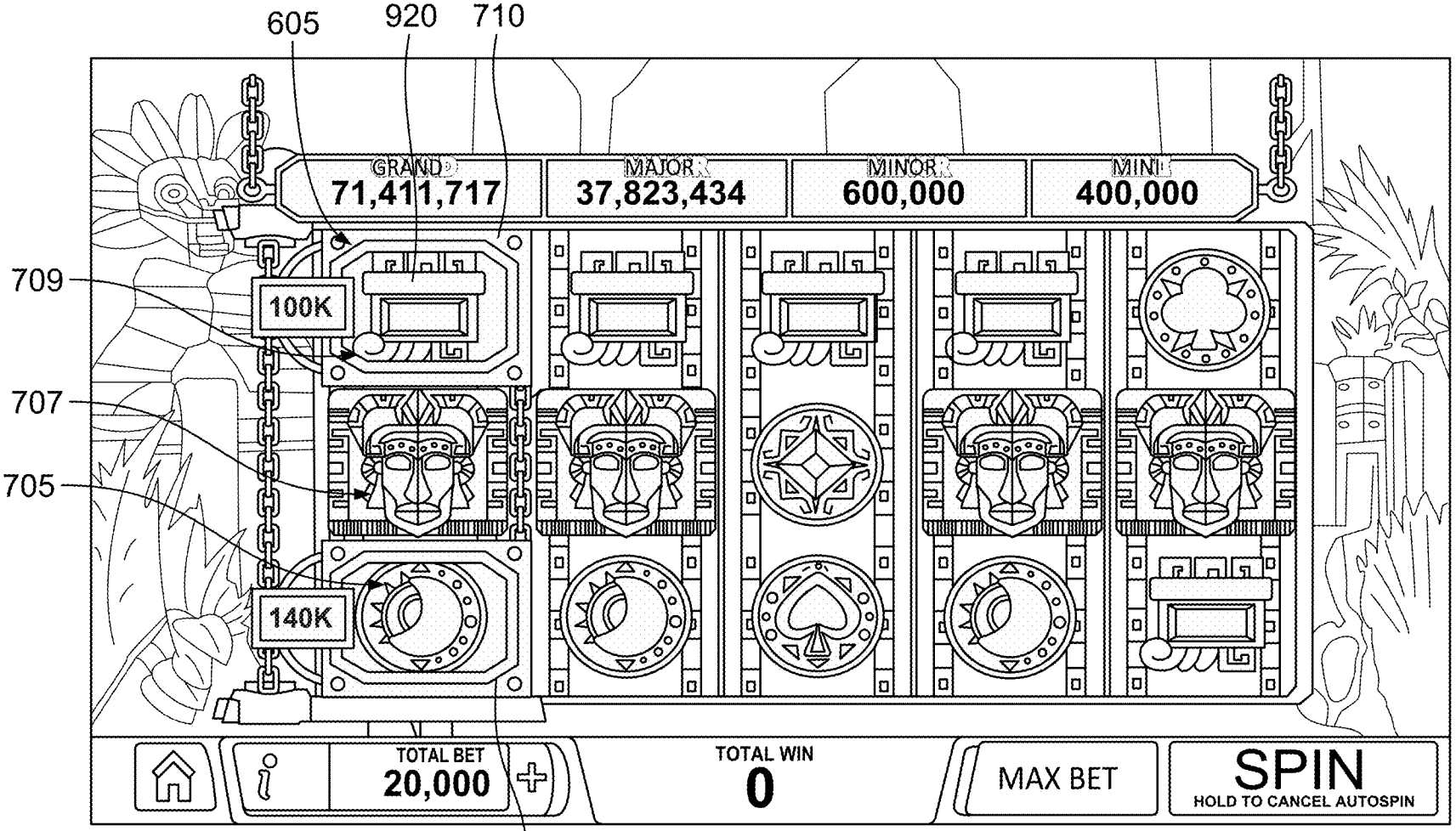
FIG. 9A shows an example of a display that may be presented after the display of FIG. 8 according to some examples.

FIG. 9A shows an example of a display that may be presented after the display of FIG. 8 according to some examples. According to this example, the display 900 is an example of a GUI that may be presented for the next game instance after the game instance depicted in FIG. 8. According to this instance, the prize-on frame 710 is displayed in the predetermined tertiary display symbol location of column 605, row 709, which is adjacent to the secondary display symbol location. According to some such implementations, a series of images that depict the prize-on frame 710 being raised to column 605, row 709 may be presented. In some such implementations, corresponding sounds, which may include clinking sounds corresponding to movement of the chains 825, may be presented.

However, in this example the process of determining whether the game outcome presentation will involve displaying one or more other prize-on frames involves one or more random processes, which may be implemented via one or more RNG calls. In this example, the process of determining whether the game outcome presentation will involve displaying a prize-on frame in the display symbol location of column 605, row 705 involved one or more RNG calls. In this particular instance, it was determined in block 504 that the prize-on frame 915 would be presented in the display symbol location of column 605, row 705. According to this example, the display symbol location of column 605, row 705 would be considered a predetermined initial display symbol location for the prize-on frame 915.

In this example, the prize-on frame 710 is displayed in the same display symbol location as the display symbol 920. In this particular instance, there is a winning combination of symbols that includes the display symbol 920.

Figure 9B:
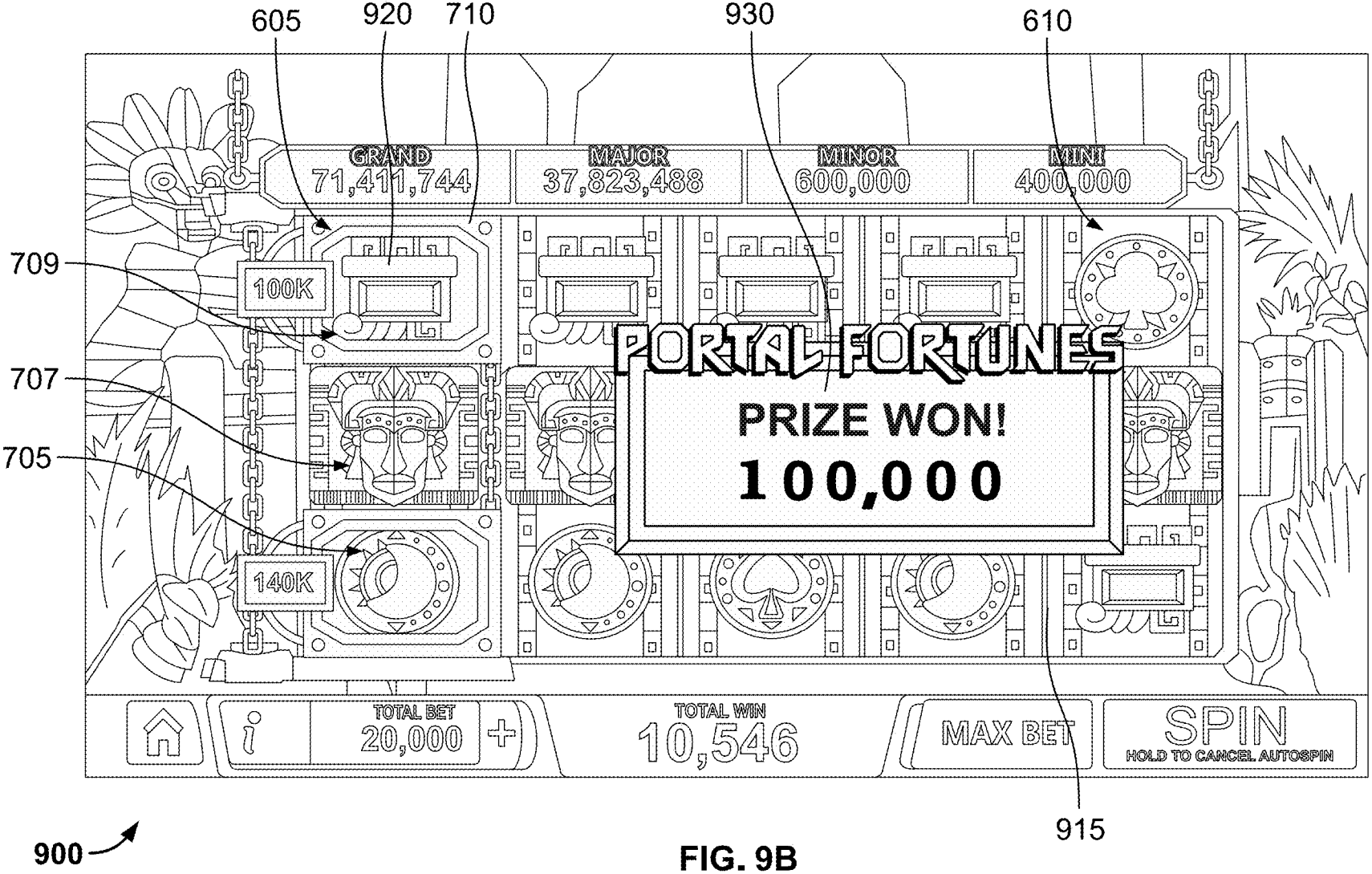
FIG. 9B shows an example of a display that may be presented after the display of FIG. 9A according to some examples.

FIG. 9B shows an example of a display that may be presented after the display of FIG. 9A according to some examples. According to this implementation, the display 925 is an example of a GUI that may be presented in block 508 of FIG. 5. Because there is a winning combination of symbols that includes the display symbol 920 in this instance, banner 930 indicates that the 100,000 credits that are indicated on the prize-on frame 710 will be awarded. According to this example, a subsequent display will indicate the additional 100,000 credits in the "Total Win" field.

As noted elsewhere herein, in some implementations prize-on frames may be presented in display symbol locations other than the rows of column 605. In some such implementations, prize-on frames may be presented in the display symbol locations of one or more other columns, such as the column 610. In some such implementations, credit or jackpot awards may be indicated on the prize-on frames that are presented in one column and multiplier symbols may be indicated on the prize-on frames that are presented in another column.

According to one such example, credit or jackpot awards may be indicated on the prize-on frames that are presented in column 605 and multiplier symbols may be indicated on the prize-on frames that are presented in column 610. For example, if a multiplier symbol of 2X were indicated on a prize-on frame presented in the display symbol location 935, which includes another instance of the winning combination of symbols including the display symbol 920, the 100,000 credit award would have been doubled to 200,000.

Figure 10A:
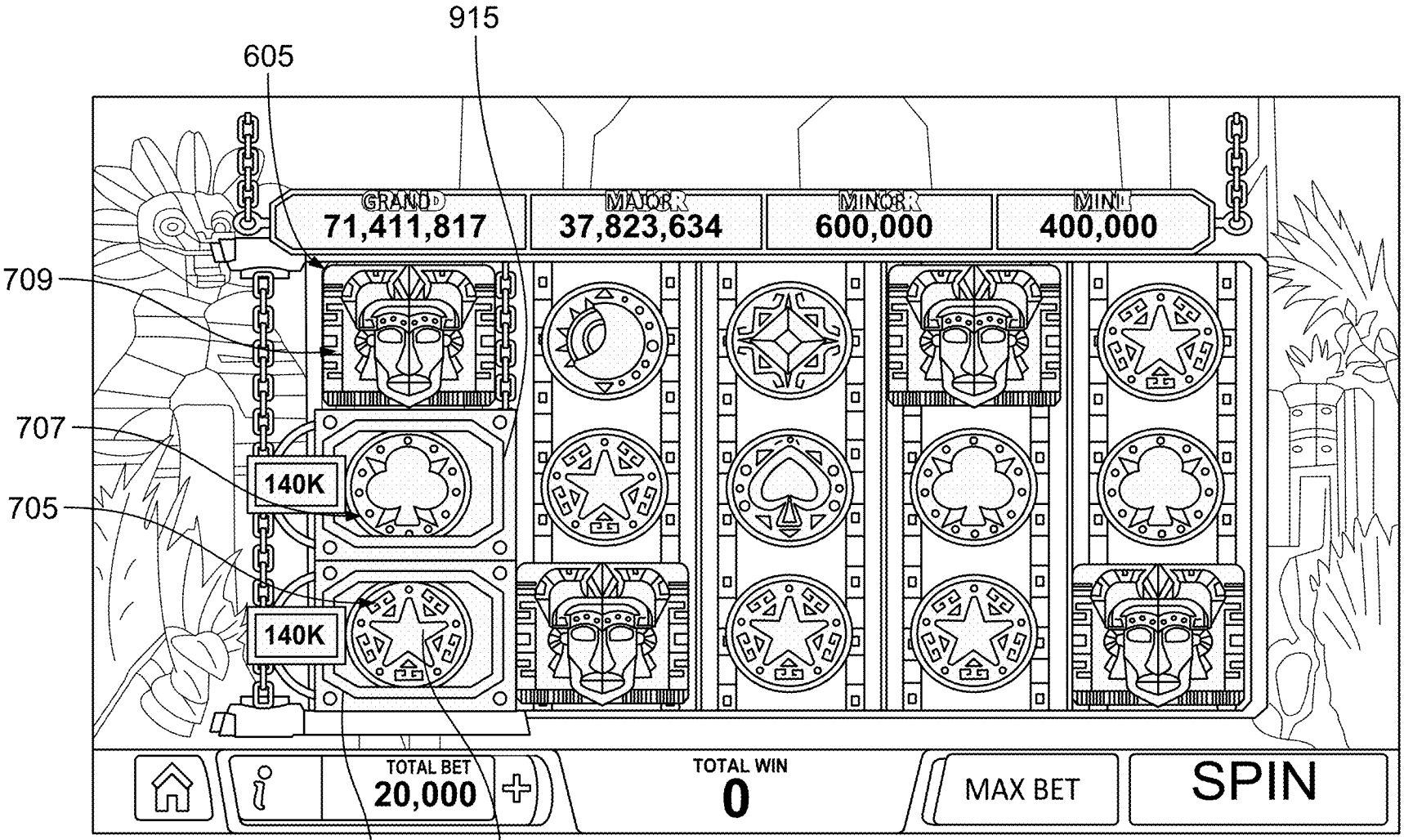
FIG. 10A shows an example of a display that may be presented after the display of FIGS. 9A and 9B according to some examples.

FIG. 10A shows an example of a display that may be presented after the display of FIGS. 9A and 9B according to some examples. According to this example, the display 1000 is an example of a GUI that may be presented for the next game instance after the game instance depicted in FIGS. 9A and 9B. According to this instance, the prize-on frame 710 is no longer being presented. According to this example, the display symbol location of column 605, row 707 would be considered a predetermined secondary display symbol location for the prize-on frame 915. According to this example, the display symbol location of column 605, row 705 would be considered a predetermined initial display symbol location for the prize-on frame 1005.

Figure 10B:
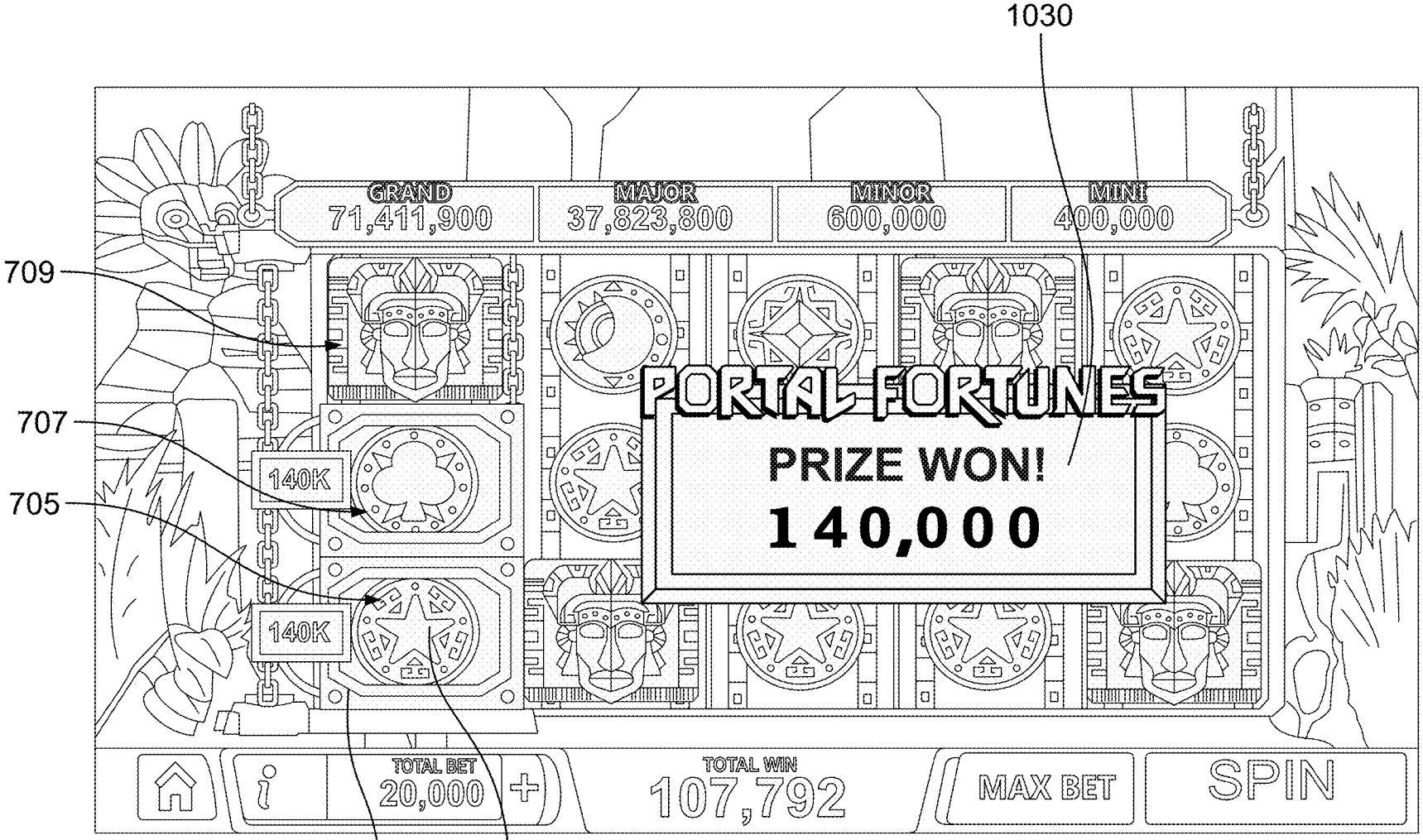
FIG. 10B shows an example of a display that may be presented after the display of FIG. 10A according to some examples.

FIG. 10B shows an example of a display that may be presented after the display of FIG. 10A according to some examples. According to this implementation, the display 1005 is another example of a GUI that may be presented in block 508 of FIG. 5. Because there is a winning combination of symbols that includes the display symbol 1010 in this instance, banner 1030 indicates that the 140,000 credits that are indicated on the prize-on frame 1005 will be awarded. According to this example, the "Total Win" field is in the process of displaying a sequence of images that shows a progression of credit values that will culminate in the total win amount that will eventually be displayed.

Figure 10C:
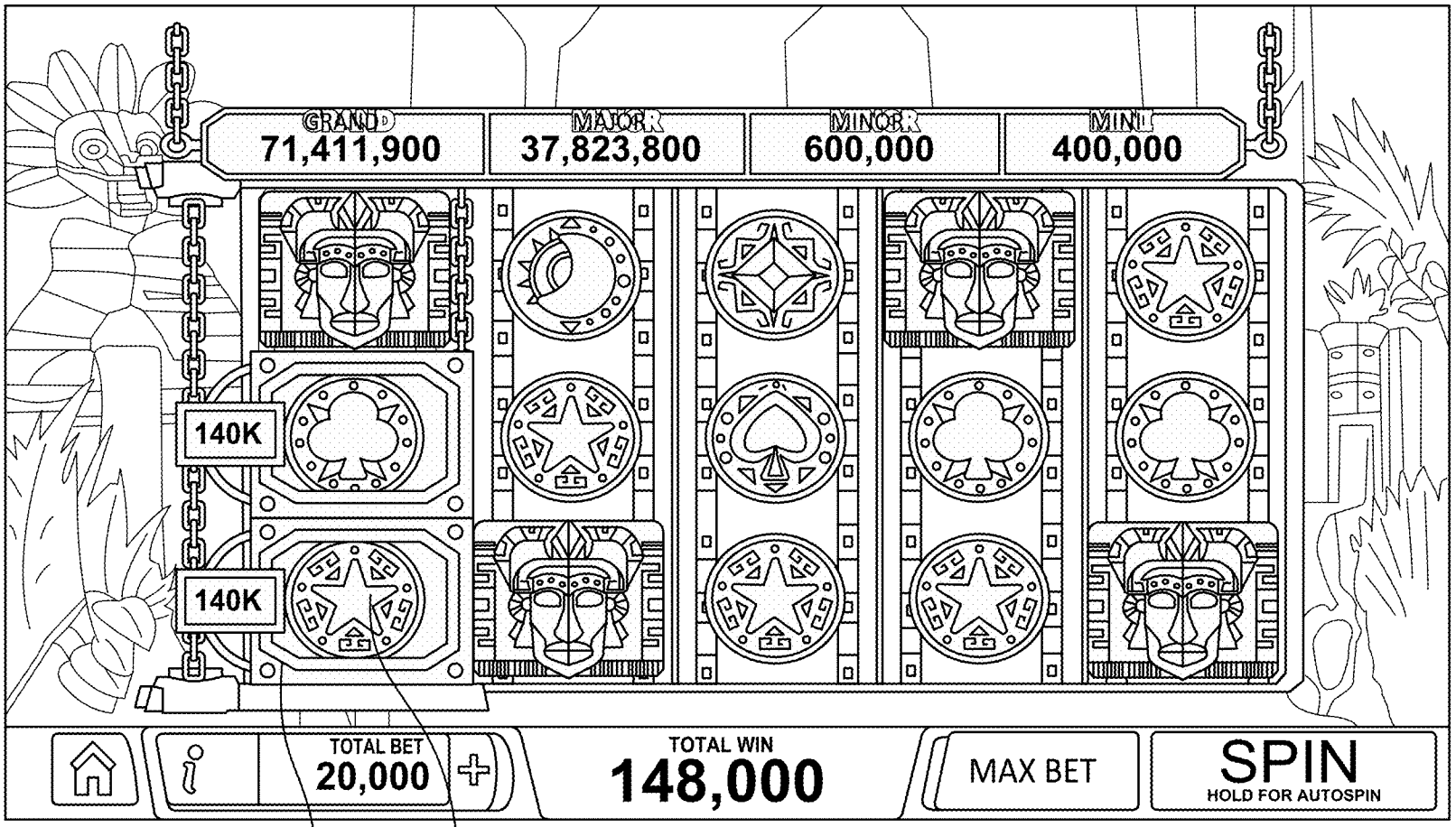
FIG. 10C shows an example of a display that may be presented after the display of FIG. 10B according to some examples.

FIG. 10C shows an example of a display that may be presented after the display of FIG. 10B according to some examples. According to this implementation, the display 1005 is another example of a GUI that may be presented in block 508 of FIG. 5. According to this example, the "Total Win" field indicates the 140,000 credits awarded due to the effect of the prize-on frame 1005 on the winning combination of symbols included the display symbol 1010, plus an additional 8,000 credits that were awarded during this game instance, e.g. as an award for the winning combination of symbols.

Figure 11:
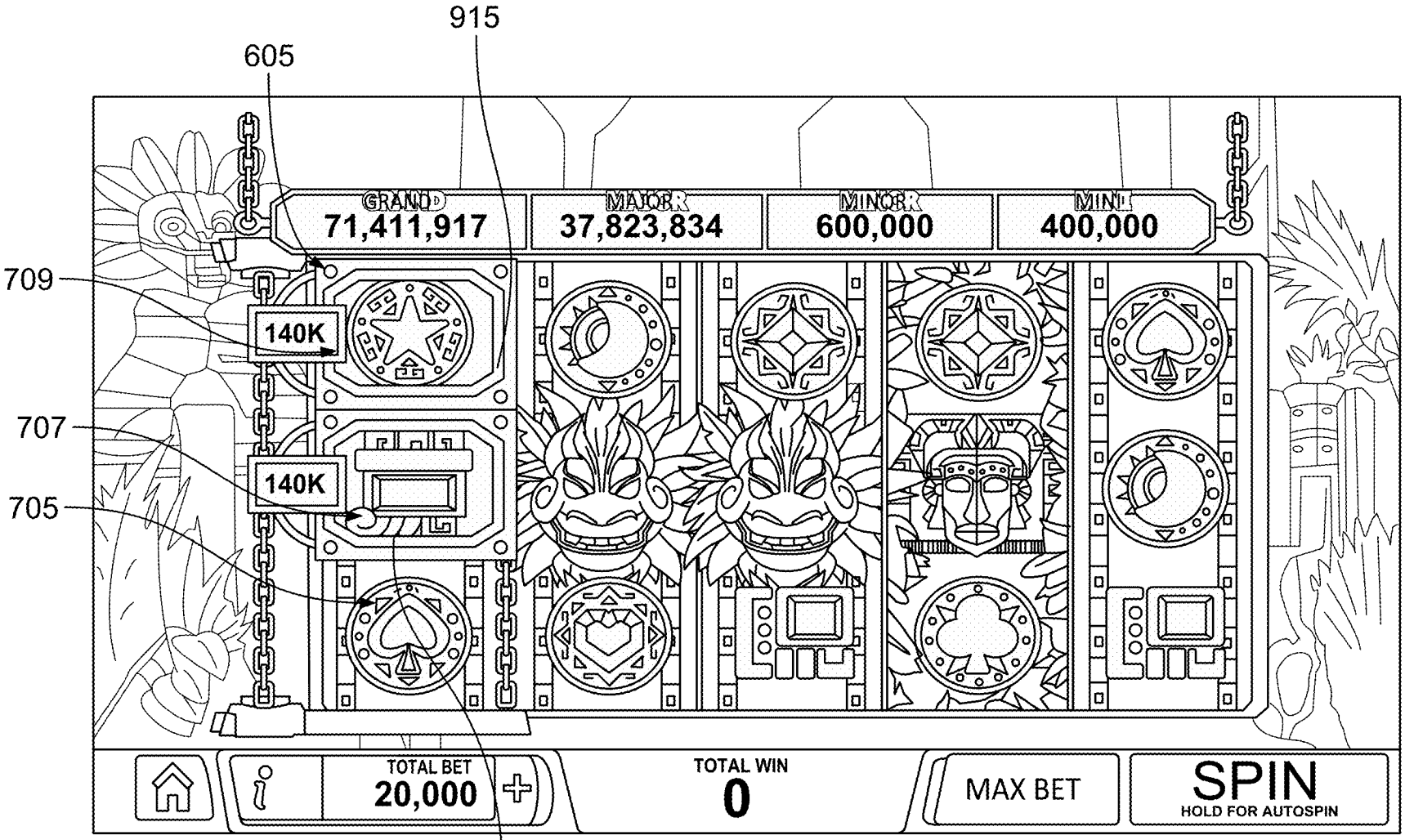
FIG. 11 shows an example of a display that may be presented after the display of FIG. 10C according to some examples.

FIG. 11 shows an example of a display that may be presented after the display of FIG. 10C according to some examples. According to this example, the display 1100 is an example of a GUI that may be presented for the next game instance after the game instance depicted in FIGS. 10A-10C. According to this instance, the prize-on frame 915 is displayed in the predetermined tertiary display symbol location of column 605, row 709. According to some such implementations, a series of images that depict the prize-on frame 915 being raised to column 605, row 709 may be presented. In some such implementations, corresponding sounds, which may include clinking sounds corresponding to movement of the chains 825, may be presented.

In the example shown in FIG. 11, the display symbol location of column 605, row 707 would be considered a predetermined secondary display symbol location for the prize-on frame 1005. In this instance, the game outcome did not include a prize-on frame in the predetermined initial display symbol location of column 605, row 705. According to this example, this particular game instance did not include a winning combination of symbols that included the symbol within the prize-on frame 915 or the symbol within the prize-on frame 1005.

Figure 12:
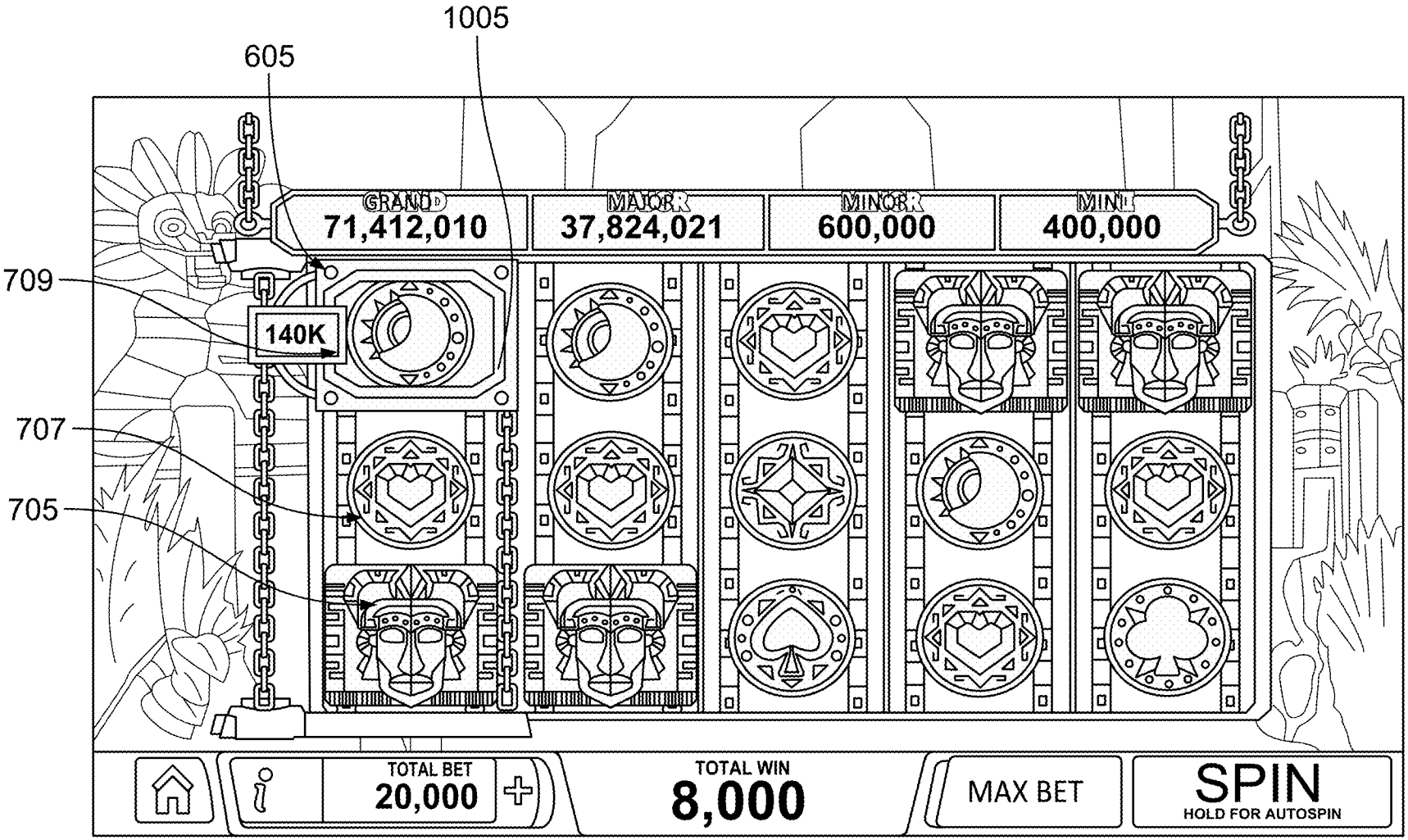
FIG. 12 shows an example of a display that may be presented after the display of FIG. 11 according to some examples.

FIG. 12 shows an example of a display that may be presented after the display of FIG. 11 according to some examples. According to this example, the display 1200 is an example of a GUI that may be presented for the next game instance after the game instance depicted in FIG. 11. According to this instance, the prize-on frame 1005 is displayed in the predetermined tertiary display symbol location of column 605, row 709. According to some such implementations, a series of images that depict the prize-on frame 1005 being raised to column 605, row 709 may be presented. In some such implementations, corresponding sounds, which may include clinking sounds corresponding to movement of the chains 825, may be presented.

In this instance, the game outcome did not include a prize-on frame in the predetermined initial display symbol location of column 605, row 705. In the example shown in FIG. 12, this particular game instance did not include a winning combination of symbols that included the symbol within the prize-on frame 1005.

Figure 13:
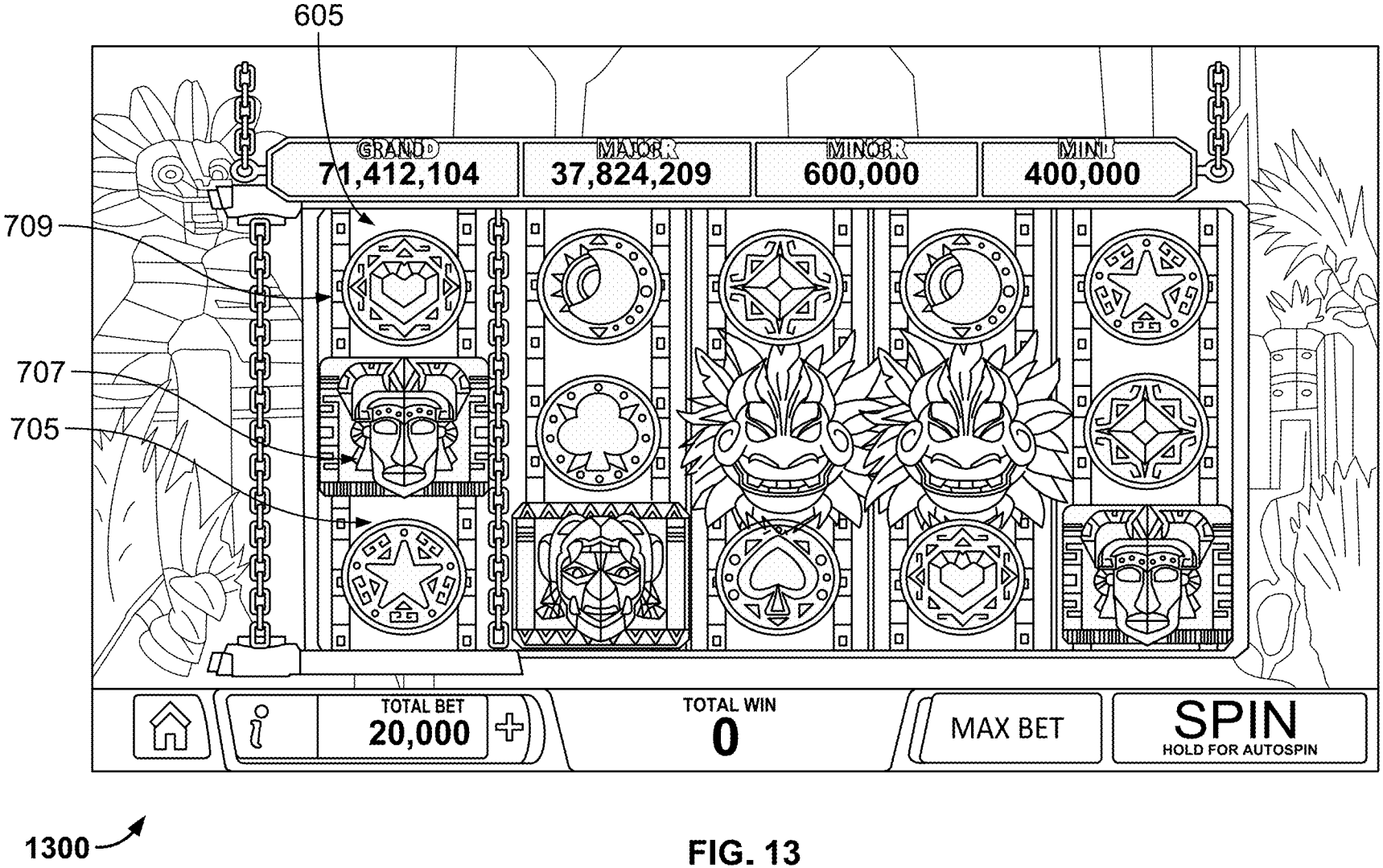
FIG. 13 shows an example of a display that may be presented after the display of FIG. 12 according to some examples.

FIG. 13 shows an example of a display that may be presented after the display of FIG. 12 according to some examples. According to this example, the display 1200 is an example of a GUI that may be presented for the next game instance after the game instance depicted in FIG. 12. In this instance, the game outcome did not include a prize-on frame in the predetermined initial display symbol location of column 605, row 705.

Figure 14:
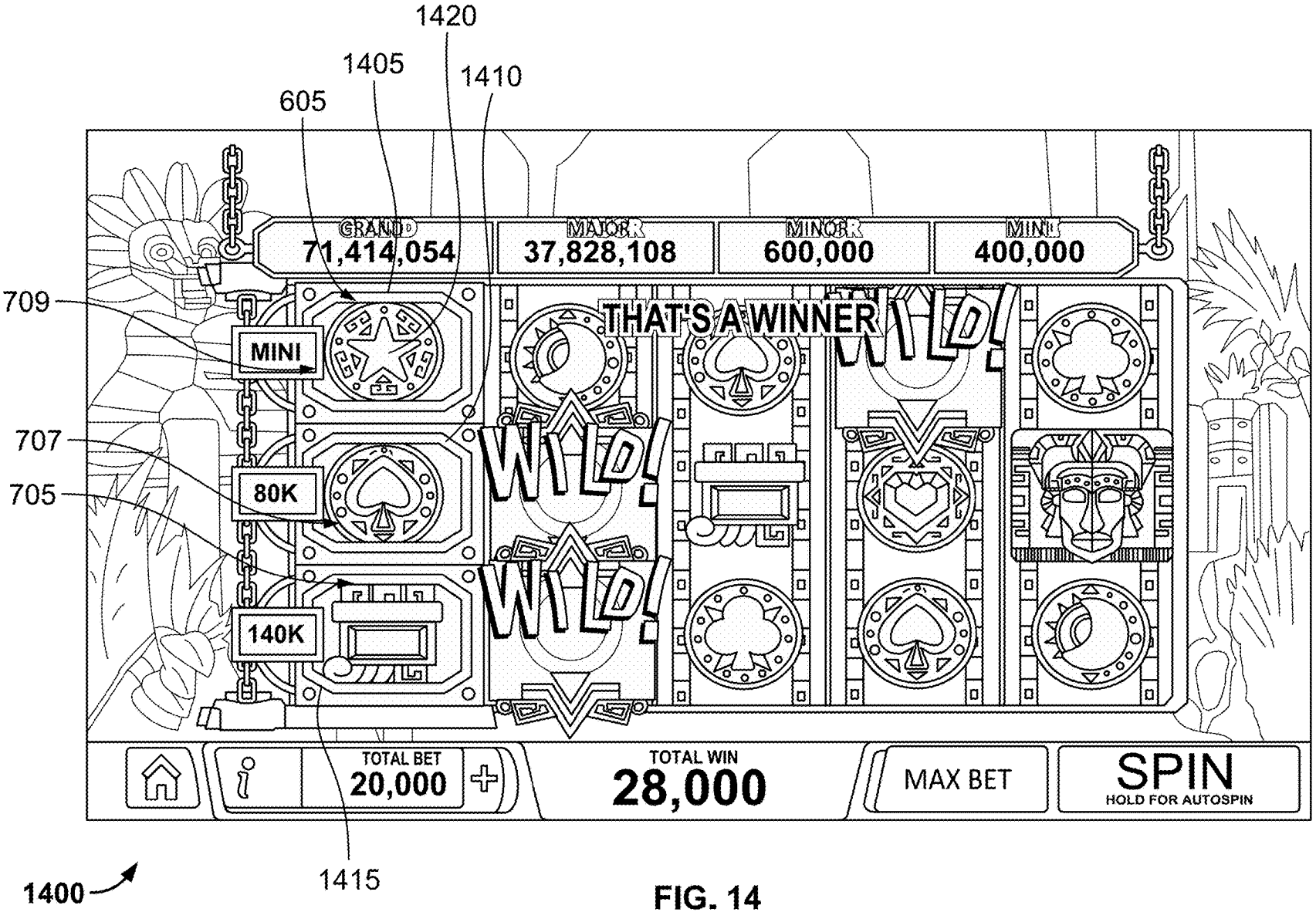
FIG. 14 shows another example of a display that may be presented according to one implementation of the method of FIG. 5.

FIG. 14 shows another example of a display that may be presented according to one implementation of the method of FIG. 5. In this example, prize-on frames are displayed in all of the rows of column 605. In this example, the prize-on frame 1405 indicates a progressive jackpot, which is the mini jackpot in this example. If the display symbol 1420 were part of a winning combination of display symbols, the current value of the mini jackpot would be awarded in some examples.

According to this example, the prize-on frames 1410 and 1415 indicate credit awards. In this example, the prize-on frame 1410 is in a predetermined secondary display symbol location and the prize-on frame 1415 is in a predetermined initial display symbol location.

According to some implementations, a prize-on frame may remain in the same display symbol location for more than one instance of a game. For example, the prize-on frame 1410 may remain in the predetermined secondary display symbol location for more than one instance of a game. In some such examples, the prize-on frame may be presented in the same display symbol location until a display symbol presented in the same display symbol location is part of a winning combination of display symbols.

According to some such implementations, one prize-on frame may remain in the same display symbol location for more than one instance of a game while one or more other prize-on frames are presented in a sequence of display symbol locations. According to some such implementations, a first prize-on frame may be presented in a first display symbol location during multiple instances of the wagering game while a second prize-on frame is presented in a predetermined sequence of display symbol locations. In some such examples, the predetermined sequence of display symbol locations may include the first display symbol location.

For example, in the next game instance after the one depicted in FIG. 14, the prize-on frame 1415 may advance to the predetermined secondary display symbol location of column 605, row 707. In some such implementations, the prize-on frame 1410, or some representation of the prize-on frame 1410, also may be displayed in the same position. According to some such examples, a prize-on frame that indicates both 140K credits and 80K credits may be displayed in the same position. In other implementations, the larger of the two credit values will be displayed when two prize-on frames are occupying the same display symbol location. In some examples, in a subsequent game instance the prize-on frame 1415 may advance to the predetermined tertiary display symbol location of column 605, row 709. According to some such implementations, the prize-on frame 1410 will continue to be displayed in column 605, row 707. In some such implementations, the prize-on frame 1410 will once again have an indicated value of 80K credits.

While specific examples have been described with respect to the figures, it will be appreciated that many modifications and changes may be made by those skilled in the art without departing from the scope of the present disclosure. For example, although some examples are described as embodiments of base games, the concepts disclosed herein can also be applied to other types of games, such as feature games or bonus games, e.g., free spins of a slot game. Similarly, although some examples are described as embodiments of feature games or bonus games, e.g., free spins of a slot game, the concepts disclosed herein can also be applied to other types of games, such as base games. Any variation and derivation from the above description and figures are included in the scope of the present disclosure as defined by the claims.

The invention claimed is:

1. An end user device (EUD), comprising:

a display system including one or more displays;

an interface system including at least one network interface and at least one user interface; and a control system including one or more processors, the control system being configured for:

receiving, via the interface system, user input for initiation of an instance of a wagering game, the wagering game comprising a slot game;

determining a game outcome and corresponding display symbols for the instance of the wagering game, wherein determining the game outcome involves:

determining whether a game outcome presentation will involve displaying a prize-on frame in one or more predetermined display symbol locations based on a first random number generator (RNG) call generated by application programming interfaces (APIs), in accordance with a first lookup table associating the first RNG call with different outcome presentation options; and determining a game outcome award based on a second RNG call, different from the first RNG call, generated by the APIs, in accordance with a second lookup table associating the second RNG call with different outcome award options;

controlling the display system to display user interface (UI) outcomes illustrating the game outcome, wherein displaying UI outcomes involves:

displaying the display symbols at a plurality of display symbol locations on a display device of the display system, wherein the plurality of display symbol locations are arranged in a plurality of display symbol rows and display symbol columns; and for game instances in which it is determined that the game outcome presentation will involve displaying a prize-on frame in one or more predetermined display symbol locations, displaying the prize-on frame around one or more of the display symbols in the one or more predetermined display symbol locations; and controlling the display system to present award effects corresponding to a game outcome award determination, wherein if the control system determined that no prize-on frame would be presented for an instance of the wagering game immediately prior to a current instance of the wagering game and the control system determines that a prize-on frame will be displayed during the current instance of the wagering game, the control system is configured to determine that the prize-on frame can only be displayed in a predetermined initial display symbol location.

2. The gaming device of claim 1, wherein the game outcome presentation involves displaying a prize-on frame in a predetermined display symbol location and wherein determining the game outcome award involves determining whether a display symbol presented in the predetermined display symbol location is part of a winning combination of display symbols.

3. The gaming device of claim 2, wherein it is determined that the display symbol presented in the predetermined display symbol location is part of the winning combination of display symbols, wherein the prize-on frame indicates a credit value and wherein determining the game outcome award involves awarding a credit value corresponding to the credit value indicated on the prize-on frame.

4. The gaming device of claim 2, wherein it is determined that the display symbol presented in the predetermined display symbol location is part of the winning combination of display symbols, wherein the prize-on frame indicates a progressive jackpot and wherein determining the game outcome award involves awarding a credit value corresponding to a current credit value of the progressive jackpot.

5. The gaming device of claim 1, wherein the predetermined initial display symbol location is a predetermined display symbol column.

6. The gaming device of claim 5, wherein the predetermined initial display symbol location is a predetermined display symbol row of the predetermined display symbol column.

7. The gaming device of claim 1, wherein if the control system determines that a prize-on frame will be presented in the predetermined initial display symbol location, the control system is configured to determine that a prize-on frame will be displayed in a next instance of the wagering game that is immediately after the current instance of the wagering game.

8. The gaming device of claim 7, wherein the control system is configured to determine that the prize-on frame that is displayed in the next instance of the wagering game will be displayed in a predetermined secondary display symbol location.

9. The gaming device of claim 8, wherein the predetermined secondary display symbol location is adjacent to the predetermined initial display symbol location.

10. The gaming device of claim 8, wherein the prize-on frame that is displayed in the next instance of the wagering game will match the prize-on frame that is displayed in the current instance of the wagering game.

11. The gaming device of claim 1, wherein a display symbol is randomly selected for a display symbol location in which a prize-on frame is displayed.

12. The gaming device of claim 1, wherein determinations of the game outcome and corresponding display symbols for the instance of the wagering game are based on one or more random numbers output from a random number generator (RNG).

13. The gaming device of claim 12, wherein determining the game outcome and corresponding display symbols for the instance of the wagering game involves making one or more RNG calls to a game processing backend system.

14. The gaming device of claim 1, wherein the game outcome presentation involves displaying a prize-on frame in two or more predetermined display symbol locations.

15. The gaming device of claim 1, wherein all of the one or more predetermined display symbol locations are in a single display symbol column.

16. The gaming device of claim 15, wherein if the control system determines that a prize-on frame will be presented in a predetermined initial display symbol row of the single display symbol column during a current instance of the wagering game, the control system is configured to determine that a prize-on frame will be displayed in a predetermined secondary display symbol row of the single display symbol column during a next instance of the wagering game that is immediately after the current instance of the wagering game.

17. The gaming device of claim 16, wherein the predetermined secondary display symbol row is adjacent to the predetermined initial display symbol row.

18. The gaming device of claim 16, wherein the predetermined secondary display symbol row is above the predetermined initial display symbol row.

19. The gaming device of claim 18, wherein the control system is configured for controlling the display system to present a sequence of images corresponding to raising the prize-on frame from the predetermined initial display symbol row of the single display symbol column to the predetermined secondary display symbol row of the single display symbol column.

* * * * *